US010066333B2

(12) United States Patent
Kim et al.

(10) Patent No.: US 10,066,333 B2
(45) Date of Patent: Sep. 4, 2018

(54) WASHING MACHINE WITH BALL BALANCER AND METHOD OF CONTROLLING VIBRATION REDUCTION THEREOF

(71) Applicant: SAMSUNG ELECTRONICS CO., LTD., Suwon-si, Gyeonggi-do (KR)

(72) Inventors: Sung Jong Kim, Suwon-si (KR); Yee Lee Wong, Suwon-si (KR); Jeong Hoon Kang, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 497 days.

(21) Appl. No.: 14/628,751

(22) Filed: Feb. 23, 2015

(65) Prior Publication Data

US 2015/0240406 A1 Aug. 27, 2015

(30) Foreign Application Priority Data

Feb. 21, 2014 (KR) ..... 10-2014-0020123
Aug. 20, 2014 (KR) ..... 10-2014-0108125

(51) Int. Cl.
*D06F 33/02* (2006.01)
*D06F 37/22* (2006.01)

(52) U.S. Cl.
CPC ..... *D06F 37/225* (2013.01); *D06F 33/02* (2013.01); *D06F 2202/085* (2013.01);
(Continued)

(58) Field of Classification Search
CPC ..... D06F 37/203; D06F 33/02; D06F 35/007; D06F 39/003; D06F 2204/065
(Continued)

(56) References Cited

U.S. PATENT DOCUMENTS 4,662,193 A * 5/1987 Honda ..... D06F 33/02 68/12.05
4,782,544 A * 11/1988 Nystuen ..... D06F 35/007 68/12.14

(Continued)

FOREIGN PATENT DOCUMENTS

CN 1197863 11/1998
CN 1426499 6/2003

(Continued)

OTHER PUBLICATIONS

Chinese Office Action dated Jan. 23, 2018 in Chinese Patent Application No. 201510087817.1.

(Continued)

*Primary Examiner* — David G Cormier
*Assistant Examiner* — Thomas Bucci
(74) *Attorney, Agent, or Firm* — Staas & Halsey LLP

(57) ABSTRACT

A washing machine having a ball balancer to reduce vibration generated during dehydrating process and a vibration controlling method thereof are disclosed. In a washing machine having a ball balancer, a dehydrating process starts while residual water having a preset water level remains in the tub without draining water completely when entering the dehydrating process, and the quantity of residual water is set differently according to eccentricity so that excessive vibrations of a tub may be reduced using the weight of the residual water while passing through a resonant point. Speed of a motor is maintained at a preset speed lower than the resonant point for a preset time to release balls in the ball balancer so that excessive vibrations of the tub generated by concentrated balls and unbalanced laundry may be surely reduced. After passing through the resonant point, the residual water is drained to reduce drain noise and to prevent delay of dehydrating time.

10 Claims, 28 Drawing Sheets

(52) U.S. Cl.
CPC .. *D06F 2204/065* (2013.01); *D06F 2204/084* (2013.01); *D06F 2222/00* (2013.01)

(58) Field of Classification Search
USPC ..... 8/159, 158, 137, 147; 68/12.06, 12.05, 68/12.02, 12.04, 12.14, 23.1, 12.12, 68/12.21, 12.19, 12.16, 23.2, 12.27, 23 R; 210/144, 363, 739; 74/572.4
See application file for complete search history.

(56) References Cited

U.S. PATENT DOCUMENTS 4,843,671 A * 7/1989 Hirooka ..... D06F 35/007 68/12.14
5,042,276 A * 8/1991 Kamano ..... D06F 35/007 68/12.04
5,181,398 A * 1/1993 Tanaka ..... D06F 35/007 68/12.06
5,606,877 A * 3/1997 Hashimoto ..... D06F 35/006 68/12.04
5,687,440 A * 11/1997 Min ..... D06F 35/006 68/12.05
5,768,728 A * 6/1998 Harwood ..... D06F 39/003 68/12.04
5,806,349 A * 9/1998 Kim ..... D06F 37/245 68/23.2
5,878,456 A * 3/1999 Lee ..... D06F 35/006 68/12.04
5,890,247 A * 4/1999 Erickson ..... D06F 39/06 68/12.02
5,970,555 A * 10/1999 Baek ..... D06F 37/203 68/12.04
6,023,854 A * 2/2000 Tsunomoto ..... D06F 37/203 34/531
6,292,966 B1 * 9/2001 Lim ..... D06F 37/203 68/12.05
6,401,284 B1 * 6/2002 Jeon ..... D06F 35/007 68/140
6,460,381 B1 * 10/2002 Yoshida ..... D06F 37/203 68/12.04
8,719,986 B2 * 5/2014 Kim ..... D06F 35/005 134/10
8,959,688 B2 * 2/2015 Im ..... D06F 33/02 68/12.05
9,328,451 B2 * 5/2016 Kappler ..... D06F 39/02
2004/0139556 A1 * 7/2004 Lee ..... D06F 23/04 8/158
2004/0139557 A1 * 7/2004 Seo ..... D06F 35/007 8/159
2005/0000033 A1 * 1/2005 Park ..... D06F 35/007 8/159
2005/0044640 A1 * 3/2005 Hyeong ..... D06F 35/007 8/159
2005/0108830 A1 * 5/2005 Park ..... D06F 35/007 8/158
2005/0188473 A1 * 9/2005 Son ..... D06F 35/007 8/159
2005/0251926 A1 * 11/2005 Lee ..... D06F 37/203 8/158
2005/0257575 A1 * 11/2005 Kang ..... D06F 37/203 68/3 SS
2005/0283919 A1 * 12/2005 Kim ..... D06F 35/007 8/158
2006/0000243 A1 * 1/2006 Lee ..... D06F 33/02 68/12.06
2006/0168740 A1 * 8/2006 Ha ..... D06F 33/02 8/158
2006/0236468 A1 * 10/2006 Choi ..... D06F 33/02 8/158
2007/0107473 A1 * 5/2007 Park ..... D06F 35/007 68/12.14
2007/0124871 A1 * 6/2007 Kwon ..... D06F 35/007 8/159
2008/0066238 A1 * 3/2008 Lee ..... D06F 37/203 8/159
2008/0104769 A1 * 5/2008 Ryu ..... D06F 35/007 8/159
2008/0155760 A1 * 7/2008 Hoppe ..... D06F 39/02 8/159
2008/0172805 A1 * 7/2008 Na ..... D06F 35/007 8/159
2008/0201867 A1 * 8/2008 Bang ..... D06F 33/02 8/158
2009/0241605 A1 * 10/2009 Moore ..... D06F 37/203 68/12.06
2010/0064445 A1 * 3/2010 Nieh ..... D06F 35/006 8/159
2010/0088829 A1 * 4/2010 Park ..... D06F 37/203 8/159
2010/0154132 A1 * 6/2010 Im ..... D06F 35/006 8/159
2010/0154133 A1 * 6/2010 Choi ..... D06F 17/08 8/159
2010/0236000 A1 * 9/2010 Kim ..... D06F 35/002 8/159
2010/0281625 A1 * 11/2010 Oh ..... D06F 35/006 8/137
2012/0005840 A1 * 1/2012 Jang ..... D06F 33/02 8/137
2012/0024016 A1 * 2/2012 Dunn ..... D06F 35/007 68/12.27
2012/0144873 A1 * 6/2012 Back, II ..... D06F 37/203 68/12.05
2013/0000053 A1 * 1/2013 Miller ..... D06F 35/007 8/137
2013/0118210 A1 * 5/2013 Wee ..... D06F 37/265 68/12.06
2013/0198969 A1 * 8/2013 Kim ..... D06F 23/02 8/137
2014/0021140 A1 * 1/2014 Hwang ..... D06F 33/02 210/739
2014/0115792 A1 * 5/2014 Lee ..... D06F 37/203 8/137
2014/0236363 A1 * 8/2014 Ha ..... D06F 33/02 700/282

FOREIGN PATENT DOCUMENTS

CN 1508322 6/2004
CN 1517474 8/2004

OTHER PUBLICATIONS

Chinese Notice of Allowance dated Jun. 27, 2018 in Chinese Patent Application No. 201510087817.1.

* cited by examiner

WASHING MACHINE WITH BALL BALANCER AND METHOD OF CONTROLLING VIBRATION REDUCTION THEREOF

CROSS-REFERENCE TO RELATED APPLICATION(S)

This application claims the benefit of Korean Patent Applications No. 2014-0020123 and 2014-0108125, respectively filed on Feb. 21, 2014 and Aug. 20, 2014 in the Korean Intellectual Property Office, the disclosure of each of which is incorporated herein by reference.

BACKGROUND

1. Field

Embodiments of the present embodiment relate to a washing machine with a ball balancer to reduce vibration generated during the dehydrating cycle and a method of controlling vibration thereof.

2. Description of the Related Art

In general, a washing machine (such as a fully automatic washing machine) includes an outer tub (hereinafter, referred to as a "tub") accommodating fresh water such as washing water or rinsing water, a washing and dehydrating tub (hereinafter, referred to as a "rotating tub") rotatably installed in the tub to accommodate laundry therein, a pulsator rotatably installed in the rotating tub to generate a water current, and a motor generating a driving force to rotate the rotating tub and the pulsator. The washing machine is an apparatus removing pollution from laundry with the help of the water current and surface activities of a detergent.

A washing machine performs washing of laundry through a series of operations such as a washing process of separating pollution from laundry with water in which detergent is dissolved (for example, a wash water), a rinsing process of rinsing bubbles and/or residual detergent within the laundry with water without the detergent (for example, a rinse water), and a dehydrating process of removing moisture contained in the laundry by rotating the laundry at high speed.

If the rotating tub is rotated in an unbalanced state where laundry is not distributed in the rotating tub when the washing is performed through the series of process, an eccentric force is applied to a rotating shaft of the rotating tub so that the rotating tub rotates eccentrically and then vibrations are generated from the tub. The vibrations are worse when the rotating tub rotates for the dehydrating process and bring out stronger vibrations and louder noise.

Thus, a washing machine having a ball balance is suggested to offset the unbalanced weight caused by the unbalanced laundry and to stabilize the rotation of the rotating tub. The ball balancer prevents an eccentric force from being applied to a rotating shaft by which balls move during the rotation of the rotating tub.

However, if gathering of the balls and the unbalanced laundry have the same phase (a same position) in the washing machine having a ball balancer, vibrations of the tub are worse in a resonant region (at early dehydration) when the washing process enters the dehydrating process so that the tub strikes a frame. Then, the overall washing machine vibrates abnormally so that a malfunctioned dehydration where the dehydrating process cannot be performed occurs. To solve this problem, water is supplied again to untangle the laundry and to perform the dehydrating process again. Thus, the quantity of water increases and dehydrating time is elongated.

SUMMARY

Therefore, it is an aspect of the present embodiment to provide a washing machine having a ball balancer for reducing excessive vibrations of a tub using a weight of residual water until the tub has passed through a resonant point by which a dehydrating process starts without fully draining the water but retaining residual water at a preset level when entering a dehydrating process, and a method of controlling the vibrations thereof.

It is another aspect of the present embodiment to provide a washing machine having a ball balancer for setting a quantity of residual water differently based on eccentricity to securely reduce vibrations of a tub caused by gathering balls and unbalanced laundry, and a method of controlling vibrations thereof.

In accordance with one aspect of the present embodiment, a method of controlling vibration of a washing machine including a tub accommodating water, a rotating tub rotatably installed in the tub, a washing motor rotating the rotating tub, and a drain motor draining the water in the tub, the method including: draining the water in the tub to a preset quantity of water by driving the drain motor when a washing process or a rinsing process is completed; stopping the draining and rotating the rotating tub by driving the washing motor, when the quantity of the water in the tub reaches a preset quantity; detecting a degree of eccentricity caused by the vibration of the tub using a vibration sensor during the rotation of the rotating tub; setting a quantity of a residual water according to the detected eccentricity degree; draining the water in the tub to the preset quantity of the residual water by driving the drain motor; and stopping the draining and entering a dehydrating process, when the quantity of the water in the tub reaches the preset quantity of the residual water.

The setting the quantity of the residual water may include: setting the quantity of the residual water differently in proportion to the degree of eccentricity.

A water level of the preset quantity of water may be a first water level where the degree of eccentricity generated by unbalanced laundry is detected.

A water level of the quantity of the residual water may be a preset water level on which the residual water remaining in the tub acts as a balancer.

The preset water level may be lower than the first water level.

The method may further include: a pulsator installed in the rotating tub, wherein the preset water level is the same or lower than the bottom of the pulsator such that the residual water is easily drained.

The rotating the rotating tub may include: rotating the rotating tub by driving the washing motor at a first speed lower than a resonant point.

The resonant point may be contained in a speed region of the washing motor, the speed region causing excessive vibration of the tub when entering the dehydrating process.

The method may further include: driving the washing motor at a second speed lower than the resonant point when the quantity of the residual water remains in the tub while passing through the resonant point, thereby maintaining balance of the rotating tub.

The method may further include: draining the quantity of the residual water by driving the drain motor after passing through the resonant point.

The method may further include: the washing machine further including a ball balancer stabilizing the rotation of the rotating tub, performing a ball releasing process of releasing balls contained in the ball balancer by driving the washing motor at a second speed lower than the resonant point.

The ball releasing process may be performed when entering the dehydrating process.

The performing the ball releasing process may include: driving the washing motor at the second speed when the quantity of the residual water remains in the tub to maintain balance of the rotating tub.

The method may further include: draining the quantity of the residual water by driving the drain motor when the ball releasing process is completed.

The second speed may be lower than the first speed.

The ball releasing process may include: rotating the rotating tub in one direction by driving the washing motor at the second speed; counting a driving time of the washing motor to determine whether the counted time elapses a preset time; and maintaining a speed of the washing motor at the second speed until the driving time of the washing motor elapses the preset time.

The method may further include: draining the residual water remaining in the tub by driving the drain motor when the driving time of the washing motor elapses the preset time.

The ball balancer may be installed on at least one of an upper side and a lower side of the rotating tub, and the resonant point may be changed according to an installed position of the ball balancer.

The resonant point may be changed according to a volume of the tub.

The second speed may be changed according to the resonant point.

The second speed may gradually increase in proportion to the increasing resonant point.

The preset time may be changed according to the resonant point.

In accordance with another aspect of the present embodiment, a washing machine includes: a tub to accommodate water; a rotating tub rotatably installed in the tub; a washing motor to rotate the rotating tub; a vibration sensor to detect a degree of eccentricity caused by vibration of the tub during the rotation of the rotating tub; a drain motor to drain the water in the tub; and a control unit to drain the water in the tub to a first water level by driving the drain motor when a washing process or a rinsing process is completed, to detect the degree of eccentricity caused by the vibration of the tub using the vibration sensor by rotating the rotating tub when the water corresponding to the first water level remains in the tub, to set a quantity of residual water according to the detected eccentricity degree, to drain the water in the tub to a preset water level by driving the drain motor according to the preset quantity of residual water, and to control the washing motor to enter a dehydrating process when the quantity of residual water corresponding to the preset water level remains in the tub.

The control unit may drive the washing motor at a first speed lower than a resonant point to detect the eccentricity caused by the vibration of the tub.

The resonant point may be contained in a speed region of the washing motor, the speed region causing excessive vibration of the tub when entering the dehydrating process.

The control unit may perform a residual-water dehydrating process by driving the washing motor at a second speed lower than the resonant point while the residual water corresponding to the preset water level remains in the tub while passing through the resonant point.

The control unit may drain residual water having the preset water level by driving the drain motor after passing through the resonant point.

The washing machine may further include: a ball balancer accommodating a liquid to stabilize the rotation of the rotating tub, wherein the control unit performs a ball releasing process of releasing balls contained in the ball balancer by driving the washing motor at a second speed lower than the resonant point while passing through the resonant point after entering the dehydrating process.

The control unit may drive the washing motor at the second speed to rotate the rotating tub in one direction, and count a driving time of the washing motor to maintain the speed of the washing motor at the second speed until the driving time of the washing motor elapses a preset time.

The control unit may drain the residual water remaining in the tub by driving the drain motor when the driving time of the washing motor elapses a preset time.

The washing machine may further include: a liquid balancer to stabilize the rotation of the rotating tub, wherein the ball balancer and the liquid balancer are installed at an upper side and a lower side of the rotating tub, respectively.

According to the washing machine having a ball balancer and a method of controlling vibrations thereof of the present embodiment, the dehydrating process starts without fully draining water but retaining the residual water at a preset level when entering the dehydrating process. A quantity of residual water is set differently according to degree of eccentricity such that excessive vibration of the tub can be reduced using the weight of the residual water while passing through a resonant point. In this case, the speed of a motor maintains at a preset speed lower than a resonant point for a preset time to scatter balls in the ball balancer so that the excessive vibrations of the tub caused by the gathered balls and the unbalanced laundry can be reliably reduced. After passing through the resonant point, draining of the residual water so that draining noise can be reduced and delay of dehydrating time can be prevented. In addition, with application of the ball balancer, the volume of the rotating tub can be increased in comparison to a rotating tub having a liquid balancer so that consumer's satisfaction can be increased.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
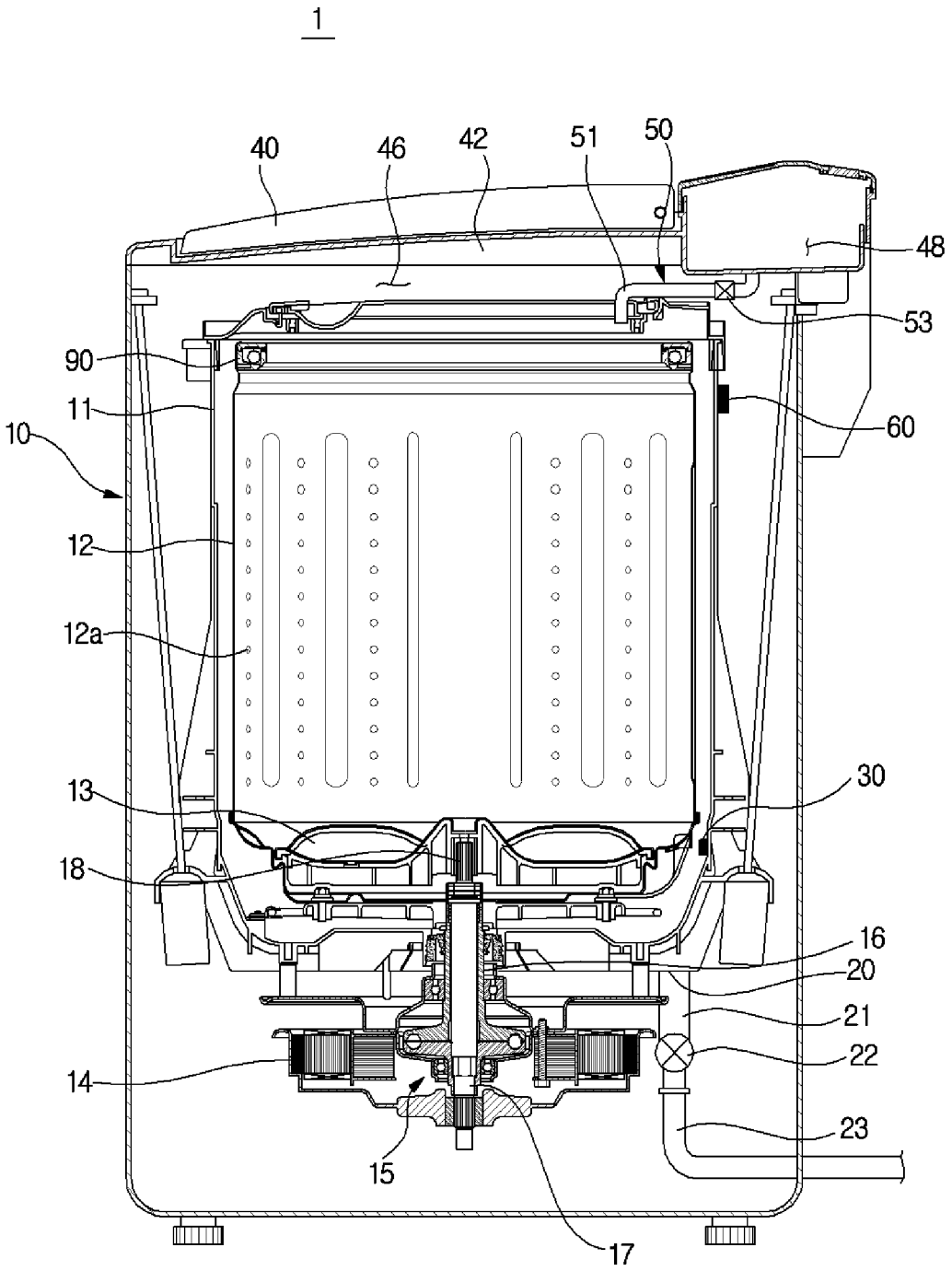
FIG. 1 is a sectional view illustrating a washing machine having a ball balancer according to an embodiment.

Reference will now be made in detail to various embodiments, examples of which are illustrated in the accompanying drawings, wherein like reference numerals refer to like elements throughout.

FIG. 1 is a sectional view illustrating a washing machine having a ball balancer according to an embodiment.

Referring to FIG. 1, a washing machine 1 according to an embodiment includes a main body 10 having an approximate box-shape and forming an external appearance, a tub 11 installed in the main body 10 to accommodate water (wash water or rinse water), a rotating tub 12 rotatably installed in the tub 11 to accommodate laundry, and a pulsator 13 rotatably installed in the rotating tub 12 to rotate clockwise or counterclockwise (forward rotation or reverse rotation) to generate a water current. The washing machine is a fully automatic washing machine having a vertical shaft.

The rotating tub 12 has an opened cylindrical upper side and a plurality of dehydrating holes 12*a* formed on the lateral side thereof.

At the lower outer side of the tub 11, installed are a washing motor 14 generating a driving force to rotate the rotating tub 12 and the pulsator 13 and a power switching unit 15 to transmit the driving force generated from the washing motor 14 to the rotating tub 12 and the pulsator 13 simultaneously or selectively.

A hollow dehydrating shaft 16 is coupled with the rotating tub 12 while a washing shaft 17 installed in a hollow portion of the dehydrating shaft 16 may be coupled with the pulsator 13 through a washing shaft coupling unit 18.

The washing motor 14 is a direct drive (DD) motor having a variable speed function. The washing motor 14 may transmit the driving force to the rotating tub 12 or the pulsator 13 selectively according to the elevating and lowering of the power switching unit 15.

A universal motor including a field coil and an armature, a brushless direct motor (BLDC) including a stator and a rotor may be employed as the washing motor 14 and any one of motors applicable to the washing machine 1 may be allowed as the washing motor 14. In addition, the washing motor 14 may be a belt type.

A drain hole 20 is formed on the bottom of the tub 11 to drain water from the tub 11 to the exterior, while a first drain tube 21 is connected to the drain hole 20. A drain motor 22 is installed in the first drain tube 21 to control drain and a second drain tub 23 is connected to an outlet of the drain motor 22 to drain water.

Although, in an embodiment, the drain motor 22 draining water is installed, but the present embodiment is not limited thereto but a drain pump or a drain valve may be installed.

Moreover, at the lower inside of the tub 11, a level sensor 30 is installed to detect a frequency varying according to a water level for the detection of quantity of water (level) in the tub 11.

An opening and closing door 40 is installed at the upper side of the main body 10 to allow laundry to be put into and taken out of the rotating tub 12 and a top cover 42 is installed on allow the door 25 to seat thereon.

The top cover 42 is formed with an opening 44 to allow laundry to be put into and taken out of the rotating tub 12, while the opening 44 may be opened and closed by the door 40.

Moreover, at the rear upper side of the main body 10, a detergent box 48 supplying detergent and fabric conditioner and a water supply 50 supplying water (wash water and rinse water) are installed.

The water supply 50 includes a water supply tube 51 connecting an external water supply tube and the detergent box 40 to supply water (wash water and rinse water) and a water supply valve 53 installed at an intermediate portion of the water supply tube 51 to control the supply of hot water and cool water. This configuration is made to allow water supplied into the tub 11 to be supplied into the tub 11 with the detergent via the detergent box 48.

At the upper outer side of the tub 11, a vibration sensor 60 is installed to measure vibrations of the tub 11 generated when the rotating tub 12 rotates eccentrically caused by the unbalanced laundry during the dehydrating process. The vibration sensor 60 may employ a micro-electric mechanical system (MEMS) sensor measuring displacement of the tub 11 moving according to vibrations of the tub 11, a three-axes acceleration sensor measuring three-axes (X-direction, Y-direction, and Z-direction) vibrations of the tub 11, and a gyro sensor as an angular sensor. In this case, a displacement signal measured by the vibration sensor 60 is mostly used to estimate the balanced state of laundry in the rotating tub 12 during acceleration from low speed to high speed for the reduction of vibrations of the tub 11 and to determine whether a high speed dehydration is carried out or not during the dehydrating process.

Meanwhile, in this embodiment, the vibration sensor 60 is installed at the upper outer side of the tub 11, but is not limited thereto. The vibration sensor 60 may be installed at the upper side of the main body 100 to which a control panel is installed or at any place where vibrations of the tub 11 generated during the dehydrating process may be detected.

During the washing process or the rinsing process, the washing motor 14 rotates the rotating tub 12 in the forward direction and in the reverse direction at a low speed so that contaminants are removed from laundry while laundry accommodated in the rotating tub 12 rotates along the inner wall of the rotating tub 12.

When the washing motor 14 rotates the rotating tub 12 at a high speed in a direction during the dehydrating process, water is separated from laundry by a centrifugal force applied to the laundry.

If unbalance in which laundry is not evenly spread in the rotating tub 12 during the rotation of the rotating tub 12 during the dehydrating process but is unbalanced when laundry is concentrated to a specific part, a concentrated force is applied to a rotating shaft of the rotating tub 12, that is, the dehydrating shaft 16, so that strong vibrations and noise are generated.

Thus, in the washing machine 1 according to an embodiment, a ball balancer 90 is installed at an upper side of the rotating tub 12 such that the rotating tub 12 may be rotated stably during the dehydrating process. This is described with reference to FIGS. 2 and 3.

Figure 2:
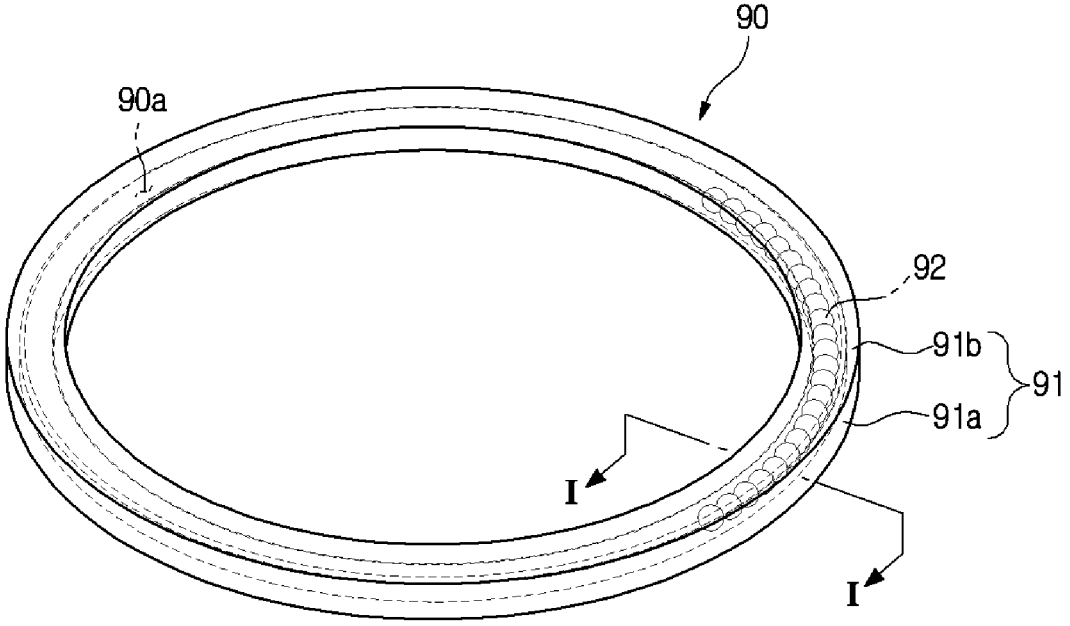
FIG. 2 is a perspective view illustrating the ball balancer employed in the washing machine according to an embodiment.
Figure 3:
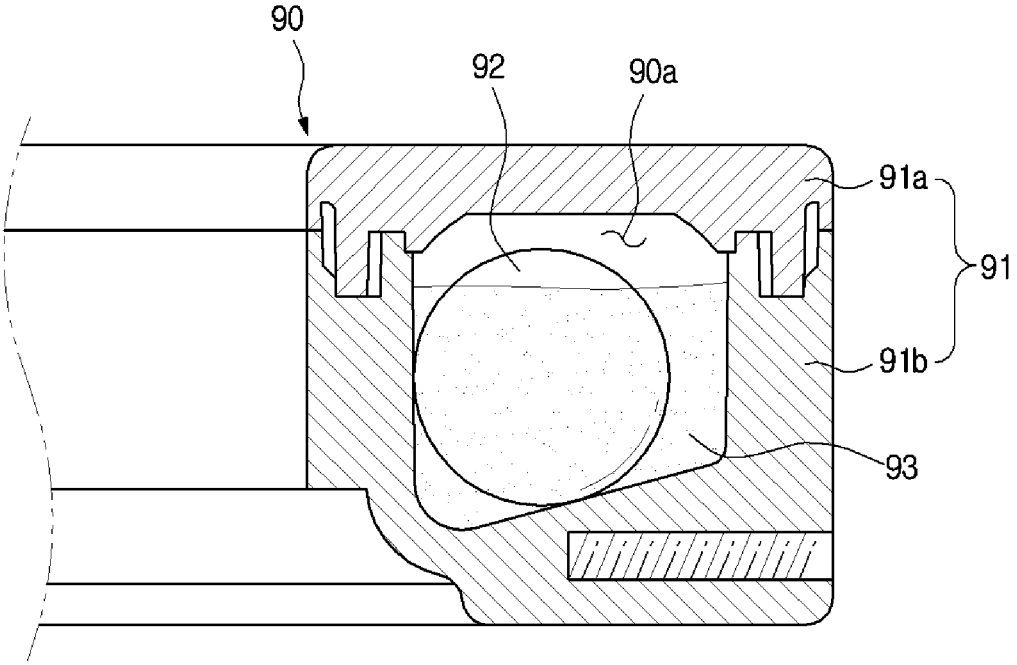
FIG. 3 is a sectional view taken along the line I-I of FIG. 2.

FIG. 2 is a perspective view illustrating the ball balancer employed in the washing machine according to an embodiment, and FIG. 3 is a sectional view taken along the line I-I of FIG. 2.

Referring to FIGS. 2 and 3, the ball balancer 90 is a circular ring and includes a balancer housing 91 provided with a circular ring-shaped race 90*a*, a plurality of balls 92 moving within the balancer housing 91, and viscosity oil having a preset viscosity and filled to a preset level in the race 90*a*. Thus, the plurality of balls 92 may move in the circumferential direction of the rotating tub 12 along the race 90*a*.

In the embodiment, the balancer housing 91 includes a first balancer housing 91*a* and a second balancer housing 91*b* having a circular ring shape and coupled with each other to form the circular ring-shaped race 90*a* therebetween. The first balancer housing 91*a* has a U-shaped cross-section to form the upper side of the race 90*a*, the inner circumferential surface, and the outer circumferential surface, and the second balancer housing 91*b* covers the upper side of the first balancer housing 91*a* to form the upper side of the race 90*a*.

The race 90*a*, as described above, has a circular ring shape and a width and height larger than a diameter of the balls 92, and guides the balls 92 to move in the circumferential direction during the rotation of the rotating tub 12. The race 90*a* has a sufficient width in comparison to the diameter of the balls 92. This is why the balls 92 may move even in the radial direction by the centrifugal force applied to the balls 92 during the rotation of the rotating tub 12.

Moreover, in the embodiment, the lower side of the race 90*a* runs outwardly in the radial direction and is inclined upwardly so that the outer surface of the race 90*a* has a diameter than the diameter of the balls 92. This is why the balls 92 move outwardly in the radial direction along the lower surface of the inclined race 90*a* only when the centrifugal force applied to the balls 92 is greater than a preset force.

The balls 92 are made of spherical metal and disposed to move along the race 90*a* in the radial direction of the rotating tub 12 to counterbalance the unbalanced load generated in the rotating tub 12 by the unbalanced laundry during the rotation of the rotating tub 12. When the rotating tub 12 rotates, the balls 92 move along the race 90*a* and perform a balancing function of the rotating tub 12.

The viscosity oil 93 is filled in the race 90*a* to have an oil surface relatively lower than the diameter of the balls 92. In the embodiment, quantity of the viscosity oil 93 filled in the race 90*a* is determined such that the ball 92 may be completely submerged in the viscosity oil 93 in the state that the viscosity oil 93 and the balls 92 have been moved in the radial direction by the centrifugal force.

The race 90*a* has a width relatively larger than a depth. Since, in this embodiment, the lower surface of the race 90*a* is inclined, the width of the race 90*a* is relatively larger than an average depth of the race 90*a*. when the width and the depth of the race 90*a* are formed as described above, a width of the viscosity oil 93 moved in the radial direction by the centrifugal force becomes larger than height of the viscosity oil filled in the lower side of the race 90*a* due to its own weight. Moreover, the upper sides of the balls 92 supported on the lower side of the race 90*a* by the own weight protrude over the upper side of the oil surface of the viscosity oil 93, while the balls moved in the radial direction by the centrifugal force are completely submerged in the viscosity oil 93.

In a case where the race 90*a* and the viscosity oil 93 are configured as described above, when the rotating tub 12 rotates at a low speed and a centrifugal force applied to the balls 92 is weak, the balls 92 remain at the outer side in the radial direction within the race 90*a*. Since the upper sides of the balls 92 are exposed to the outside of the viscosity oil 93 in this state, a viscosity force applied to the balls 92 is relatively weak and then the balls 92 may move in the circumferential direction.

Meanwhile, the ball balancer 90 may be installed on at least one of the upper side and the lower side of the rotating tub 12, and hereinafter a case where the ball balancer 90 is installed at the upper side of the rotating tub 12 will be described.

Figure 4:
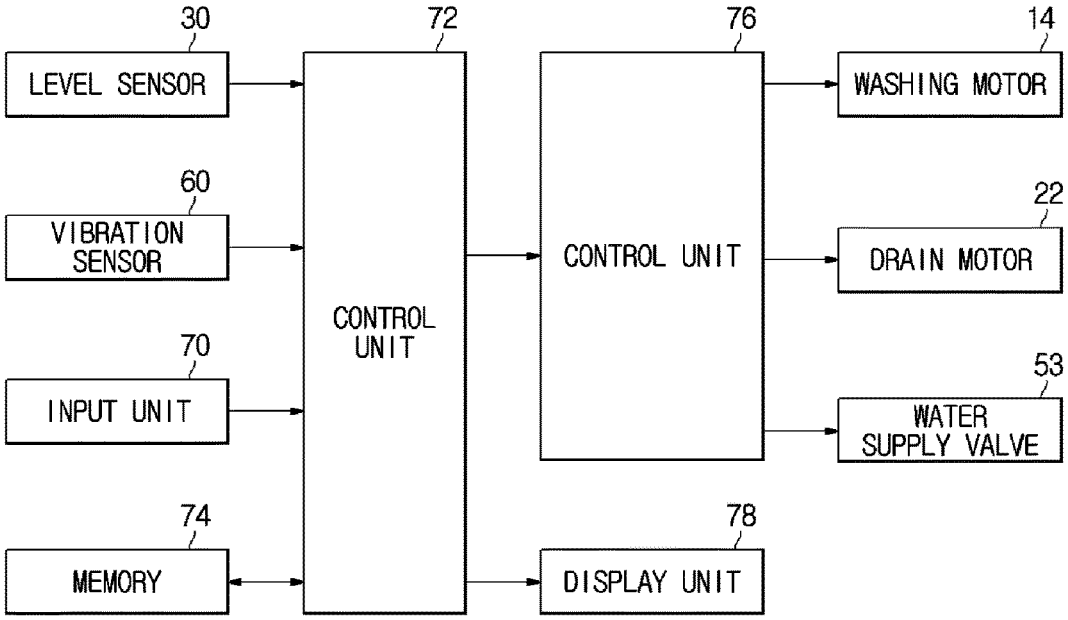
FIG. 4 is a block diagram illustrating control of the washing machine according to an embodiment.

FIG. 4 is a block diagram illustrating control of the washing machine according to an embodiment.

Referring to FIG. 4, the washing machine 1 according to an embodiment includes an input unit 70, a control unit 72, a memory 74, a driving unit 76, and a display unit 78.

The input unit 70, which inputs commands to perform a washing process, a rinsing process, and a dehydrating process of the washing machine 2 manipulated by a user, may have keys, buttons, switches, and a touch pad, and may include any device generating preset input data by pressing, touching, rotating, and the like.

The input unit 70 includes a plurality of buttons to input user commands (Power on, reservation, washing, rinsing, dehydrating, and water level, etc.) related to operations of the washing machine 1. Among the plurality of buttons, there is a course selecting button to select a washing course such as a standard course, a wool course, a boiling course, and the lime, according to laundry inserted in the washing machine 1.

The control unit 72 is a microcomputer to control overall operations of the washing machine 1 such as washing, rinsing, and dehydrating according to operating information inputted from the input unit 70. The control unit 72 sets a quantity of water for washing (target water level for washing) and for rinsing (target water level for rinsing), a target RPM and a motor operating rate (ON-OFF time of the washing motor), a time for washing and rinsing according to weight of laundry (load) in the selected washing course.

The control unit 72 performs a residual water dehydrating process started in the state that water is not completely drained but residual water remains at a preset level when entering the dehydrating process.

The residual dehydrating process starts the dehydrating without fully draining of water in the tub 11 but retaining a preset level of the residual water, that is, the residual water at a preset level after the washing process or the rinsing process and reduces vibrations of the tub 11 using the weight of the residual water while passing through a resonant point (a rotating speed of the washing motor where the vibrations of the tub are maximum, about 80 RPM). After that, the residual water is drained after passing through the resonant point.

Since the excessive displacement (maximum vibration) of the tub 11 is mainly generated at the resonant point at which the rotating speed of the washing motor 14 increased, the residual water is not drained while passing through this resonant point and the excessive vibrations of the tub 11 may be effectively reduced using the weight of the residual water.

During the residual water dehydrating process, it is preferable that the level of the residual water is not higher than the bottom surface of the pulsator 13 for prevention of bubbles and easy draining, and the quantity of the residual water is set differently according to the eccentricity.

The quantity of the residual water is different according to size and bottom shape of the tub 11 but is determined within a range about 5 L to 20 L.

In addition, when the washing process or the rinsing process before the residual water dehydrating process starts, the control unit 72 drives the washing motor 14 at a first speed (a rotating speed of the washing motor lower than the resonant point, about 70 RPM) to rotate the rotating tub 12 while retaining the residual water of a preset level, that is, a first level (about 50 L) within the tub 11.

Meanwhile, when the laundry in the rotating tub 12 is unbalanced, the tub 11 generates vibrations due to the rotation of the rotating tub 12 and the vibration sensor 60 detects the eccentricity of the rotating tub 12 due to the vibrations of the tub 11 and transmits the detected eccentricity to the control unit 72.

Thus, the control unit 72 compares the eccentricity data detected by the vibration sensor 60 with preset reference data (data to determine whether to perform a cloth untangling process of shaking and untangling laundry or not) and determines that the cloth untangling process may not be performed because the eccentricity caused by the unbalanced laundry is small when the detected data is smaller than the reference data, and enters the dehydrating process.

The control unit 72 sets the quantity of the residual water according to the eccentricity detected by the vibration sensor 60 before the dehydrating process. That is, since the larger the eccentricity is the louder the vibrations of the tub 11 are, a large quantity of the residual water applied as a balance is set to reduce vibrations of the tub 11 as much as possible.

The control unit 72 maintains the rotating speed of the washing motor 14 at a lower speed for a preset time when entering the dehydrating process, so that a ball releasing process of releasing the balls 92 within the ball balancer 90 is performed.

Since the rotating speed of the washing motor 14 is maintained at the lower speed for a preset time, the residual water may be easily drained simultaneously with release of the balls.

The ball releasing process is to maintain the rotating speed of the washing motor 14 to a second speed (a lower rotating speed lower than the resonant point, about 55 RPM) for a preset time (about 30 seconds) while passing through the resonant point and while retaining the residual water at a preset level, that is, a preset level (about 15 L) so that the balls 92 within the ball balance 90 are not concentrated.

The ball releasing process rotates the rotating tub 12 slow in a direction for release of the balls 92 after a zone where the excessive vibrations of the tub 11 are generated (a zone from entering the dehydrating to passing through the resonant point) to seat the balls 92 on the race 90*a*. Through the ball releasing process, the ball balancer 90 may maintain the balance of the rotating tub 12 effectively.

During the ball releasing process, the rotating speed of the washing motor 14 may be set to a speed where the balls 92 within the ball balancer 90 may move in a direction opposite to the direction where the rotating tub 12 rotates (about 45 RPM to 60 RPM) and a driving time of the washing motor 14 may be set to a time when the balls 92 within the ball balancer 90 may seat on the race 90*a* (about 30 seconds to 60 seconds).

Therefore, the control unit 72 includes a residual water dehydrating process of starting dehydrating in the state that the residual water remains at the preset level (about 15 L) to reduce vibrations of the tub 11 using the weight of the residual water and a ball releasing process of maintaining the rotating speed of the washing motor 14 to the first speed (about 55 RPM) for a preset time (about 30 seconds) to release the balls 92 within the ball balancer 90. After passing the resonant point (about 100 RPM), a dehydrating process in which the residual water in the tub 11 is drained and the rotating speed of the washing motor 14 is accelerated according to a preset dehydrating profile to reduce drain noise and decrease the dehydrating time is performed.

The memory 74 stores a vibration limit (a value basically inputted when a set is shipped) when it is installed horizontally in the washing machine 11 and a vibration limit reset in an installing mode after the early installation of the washing machine (or a moved and re-installation) and may be a data storing device such as a ROM, EEPROM, and the like.

Moreover, the memory 74 may store control data for controlling of operations of the washing machine 1, reference data used in controlling operations of the washing machine 1, operation data generated during the performance of an operation of the washing machine 1, setting information such as setting data inputted by the input unit 90 such that the washing machine 1 may perform an operation, times when the washing machine 1 performed a specific operation, use information containing model information of the washing machine 1, and malfunction information containing malfunction reason or malfunctioned position of the washing machine 1.

The driving unit 76 drives the washing motor 14, the drain valve, and the water supply valve 53, related to operations of the washing machine 1, according to a driving control signal from the control unit 72.

The display unit 78 displays operated state of the washing machine 1 and manipulated state by a user according to a display control signal from the control unit 72.

Hereinafter, operations and effects of the washing machine having a ball balancer according to an embodiment and a method of controlling vibrations thereof will be described.

Figure 5:
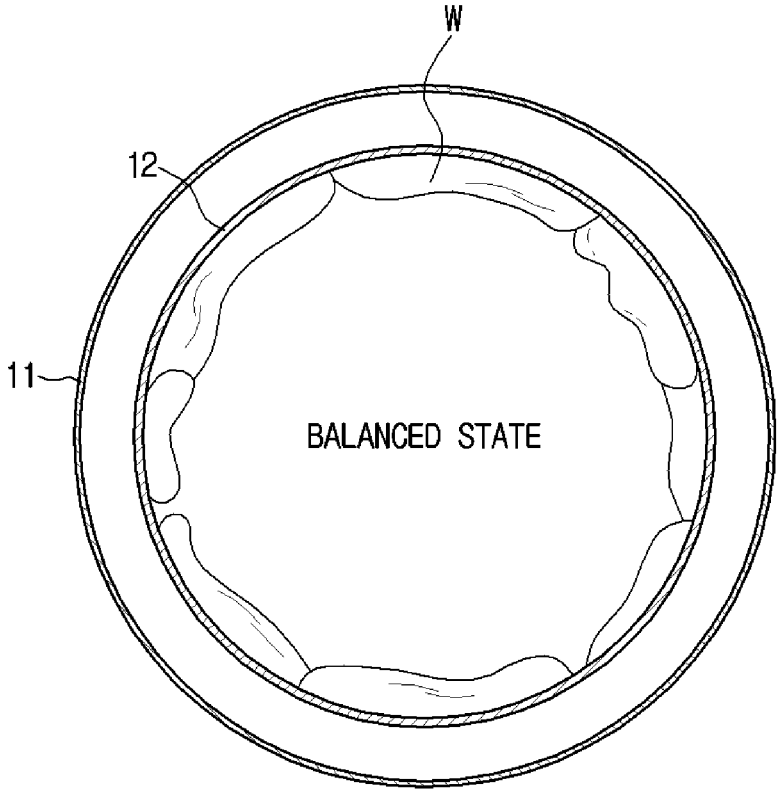
FIG. 5 is a view illustrating a balanced state of laundry in a rotating tub of an existing washing machine.
Figure 6:
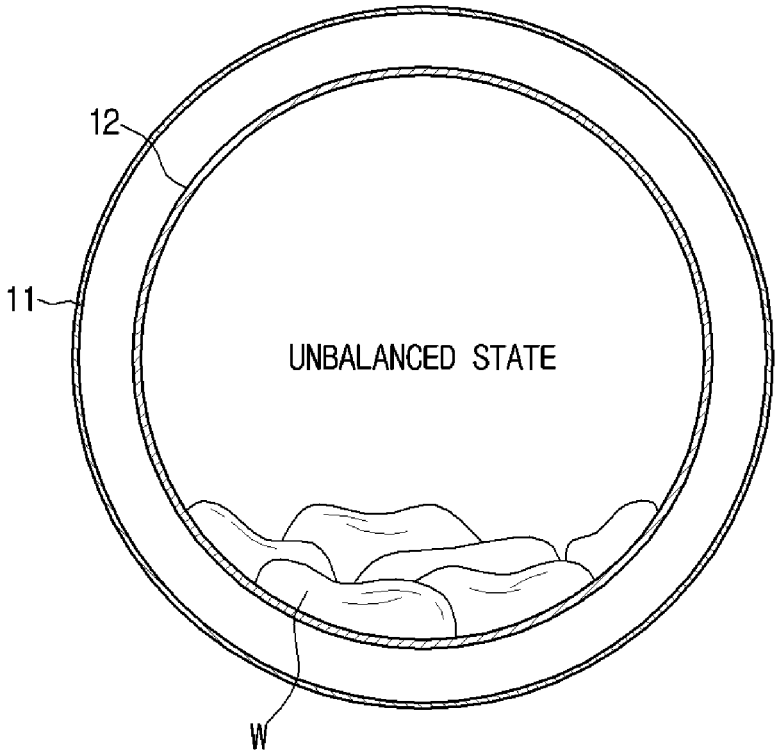
FIG. 6 is a view illustrating an unbalanced state of laundry in a rotating tub of an existing washing machine.

FIG. 5 is a view illustrating a balanced state of laundry in a rotating tub of an existing washing machine, and FIG. 6 is a view illustrating an unbalanced state of laundry in a rotating tub of an existing washing machine.

In general, the washing machine 1 performs washing of laundry using movement of the laundry W and a water current by rotating the rotating tub 12 as the washing motor 14 is driven. Since the washing machine 1 rotates at a high speed of 700 RPM to 1000 RPM during the dehydrating process, vibrations and noise are generated. The vibrations and noise generated during the dehydrating process are remarkably different according to distribution of the laundry direct before the dehydrating process.

As illustrated in FIG. 5, in the balanced state that the laundry W is evenly distributed on the inner wall of the rotating tub 12, the tub 11 does neither vibrations nor noise even when the rotating rub 12 is rotated at a high speed.

However, as illustrated in FIG. 6, in the unbalanced state that the laundry W is not evenly distributed in the rotating tub 12, when the rotating tub 12 is rotated at a high speed for the dehydrating process, a concentrated force is applied to the rotating shaft of the rotating tub 12 due to the unbalanced load generated by the unbalance of the laundry W so that the rotating tub 12 eccentrically moves and louder vibrations are generated from the tub 11 and then noise is generated.

Thus, in the embodiment, a ball balancer 90 counterbalancing the unbalanced load generated by the unbalance of the laundry W to stabilize the rotation of the rotating tub 12 is installed at the upper side of the rotating tub 12 (See FIG. 1).

In the ball balancer 90, when the unbalanced load is generated by the unbalance of the laundry W during the rotation of the rotating tub 12, the balls 92 within the balancer housing 91 move in the circumferential direction of the rotating tub 12 to a position symmetrical to a place where the unbalanced load is generated. At this time, the balls 92 correspond to the unbalanced load and thus restrict the vibrations of the tub 11 generated due to the unbalanced load.

In the dehydrating process, since the laundry W is wet in the rotating tub 12, the unbalanced phenomenon possibly occurs. Thus, in order to restrict the vibrations of the tub 11 in the early entering the dehydrating process, the ball balancer 90 may maintain balanced state of the rotating tub 12 within a short time when the dehydrating process starts.

When the dehydrating rotation of the rotating tub 12 starts as the washing motor 14 is driven, the rotating speed of the rotating tub 12 begins to increase. In the early entering the dehydrating process, since the viscosity oil 93 filled in the ball balancer 90 does not push the balls 92 up so that the balls 92 within the ball balancer 90 collide against the inner wall of the balancer housing 91 and with each other, the rotating speed of the rotating tub 12 is different from the rotating speed of the balls 92. Due to the difference between the rotating speeds of the rotating tub 12 and the balls 92, a resonant point is reached where the tub 11 vibrates excessively. When the laundry W is unbalanced, vibrations of the tub 11 become worse before the balls 92 reach a balanced position (a position where the balls are positioned opposite to the laundry W). Thus, the balls 92 to restrict vibrations in the early entering the dehydrating process rather cause excessive vibrations of the tub 11 together the laundry W. This will be described with reference to FIGS. 7 to 10.

Figure 7:
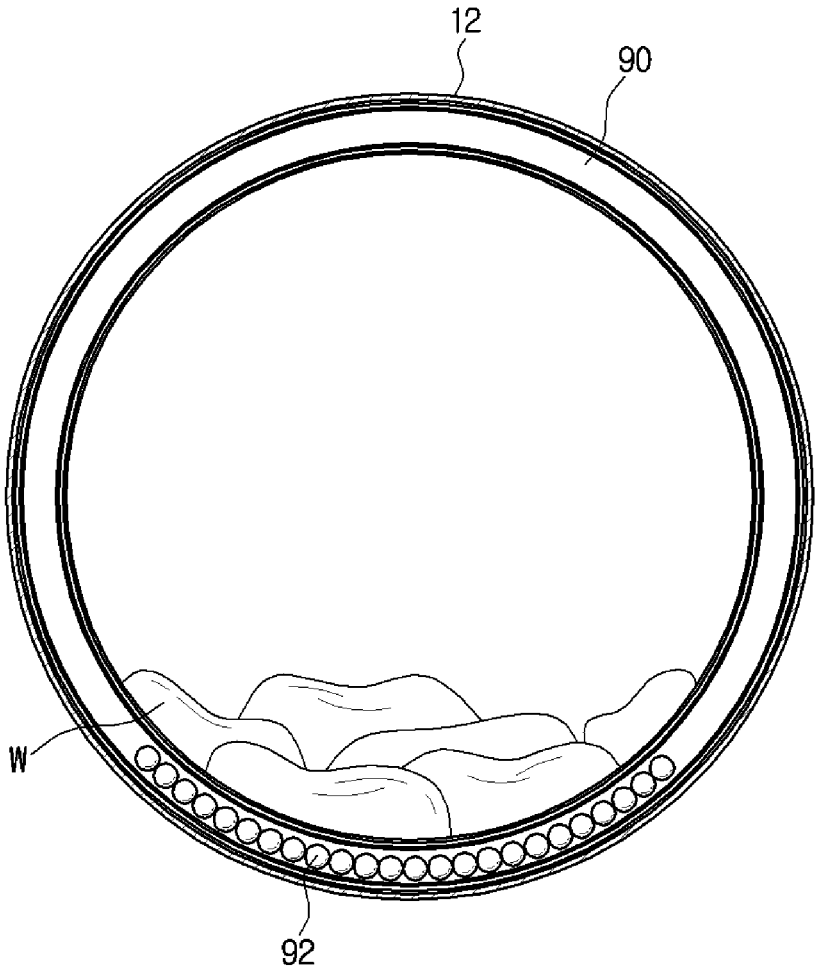
FIG. 7 is a view illustrating a case where balls and laundry are at the same phase in a washing machine having a ball balancer according to an embodiment.
Figure 8:
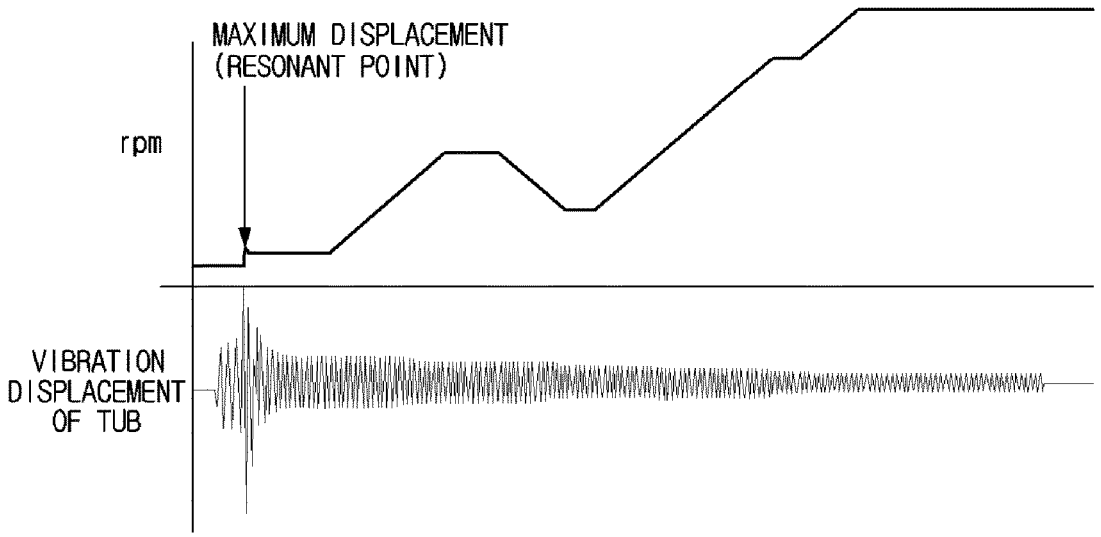
FIG. 8 is a view illustrating rotating speeds of a washing motor and amplitudes of vibrations of a tub in a state as shown in FIG. 7.
Figure 9:
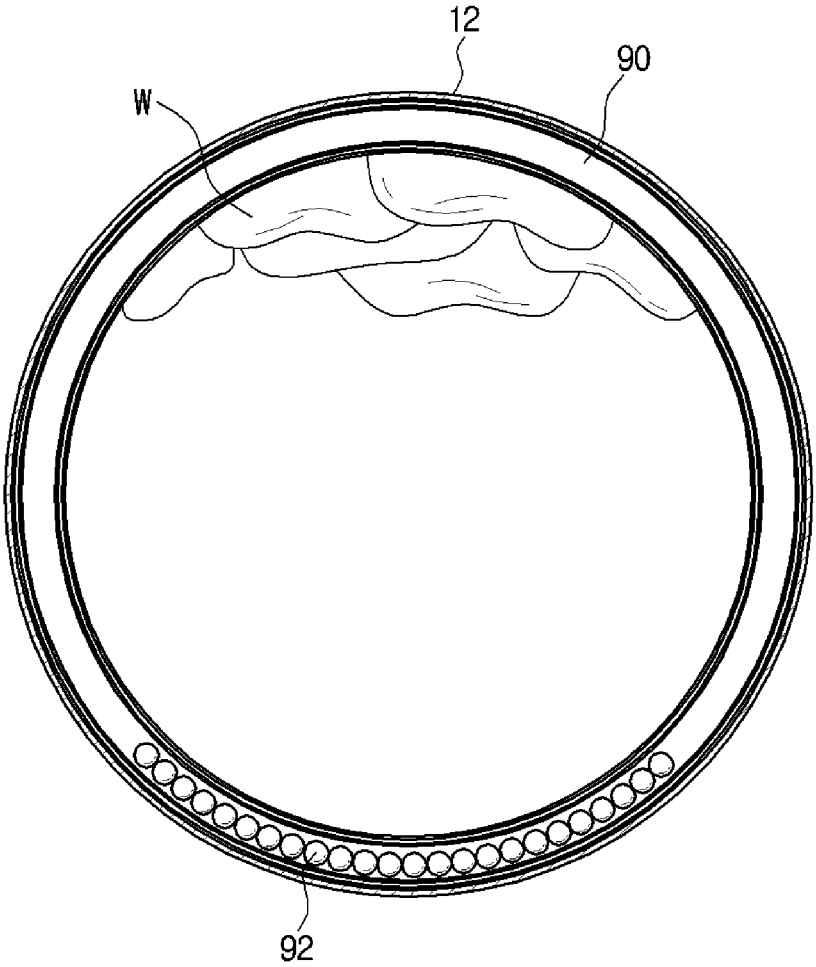
FIG. 9 is a view a case where balls and laundry are at the opposite phase in a washing machine having a ball balancer according to an embodiment.
Figure 10:
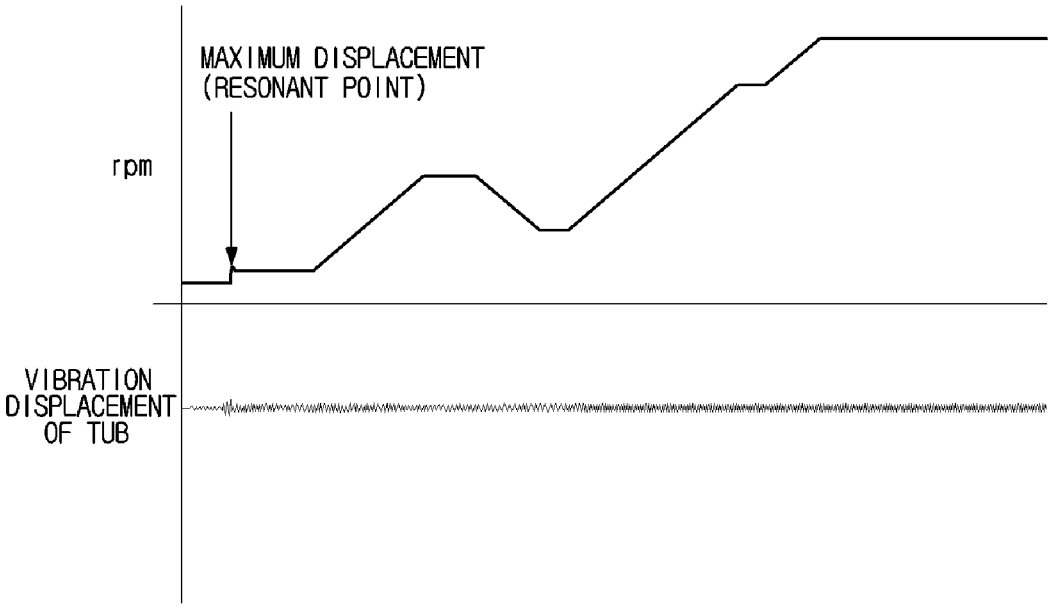
FIG. 10 is a view illustrating rotating speeds of a washing motor and amplitudes of vibrations of a tub in a state as shown in FIG. 9.

FIG. 7 is a view illustrating a case where balls and laundry are at the same phase in a washing machine having a ball balancer according to an embodiment, FIG. 8 is a view illustrating rotating speeds of a washing motor and amplitudes of vibrations of a tub in a state as shown in FIG. 7, FIG. 9 is a view a case where balls and laundry are at the opposite phase in a washing machine having a ball balancer according to an embodiment, and FIG. 10 is a view illustrating rotating speeds of a washing motor and amplitudes of vibrations of a tub in a state as shown in FIG. 9.

As illustrated in FIG. 7, when the unbalanced loads generated by the unbalanced state between the balls 92 within the ball balancer 90 and the laundry W are positioned at the same phase (the same position), the vibration displacement of the tub 11, as illustrated in FIG. 8, is maximum while passing through the resonant point in the early entering the dehydrating process. If a gap between the tub 11 and a frame of the washing machine 1 is not sufficient, the tub 11 strikes the frame of the washing machine 1 to apply a shock to the main body 10 so that a malfunctioned dehydrating where the dehydrating process cannot be performed may be generated.

On the contrary, as illustrated in FIG. 9, when the unbalanced loads generated by the unbalanced state between the balls 92 within the ball balancer 90 and the laundry W are positioned at opposite phases (opposite positions), the unbalanced loads are not high even when passing through the resonant point in the early entering the dehydrating process so that the vibration displacement of the tub 11, as illustrated in FIG. 10, is not large.

Thus, in the dehydrating process where the unbalanced state may be possibly generated, it is required a dehydrating process of releasing the balls 92 within the ball balancer 90 before passing through the resonant point and of reducing vibrations of the tub 11.

To this end, according to an embodiment, a dehydrating process is suggested of reducing vibrations of the tub 11 generated by the unbalanced state between the concentrated balls 92 and the laundry W before passing through a resonant point even when the rotating tub 12 is rotated at a high speed in the unbalanced state when the laundry W is not evenly distributed within the rotating tub 12 (See FIG. 6). This will be described with reference to FIGS. 11 and 12.

Figure 11A:
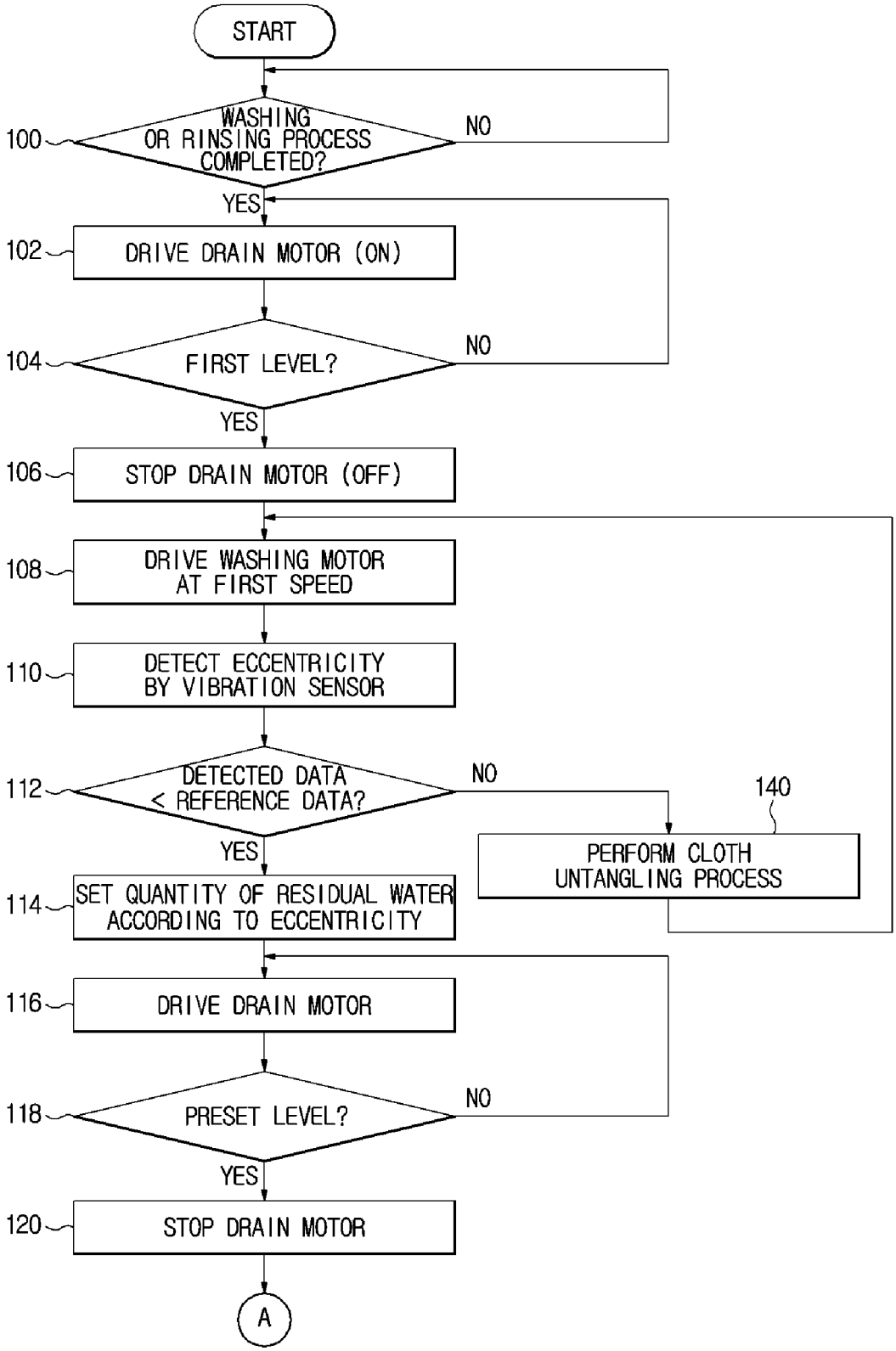
FIGS. 11A and 11B are a first flowchart illustrating a method of controlling vibrations during the dehydrating process of a washing machine having a ball balancer according to an embodiment.
Figure 11B:
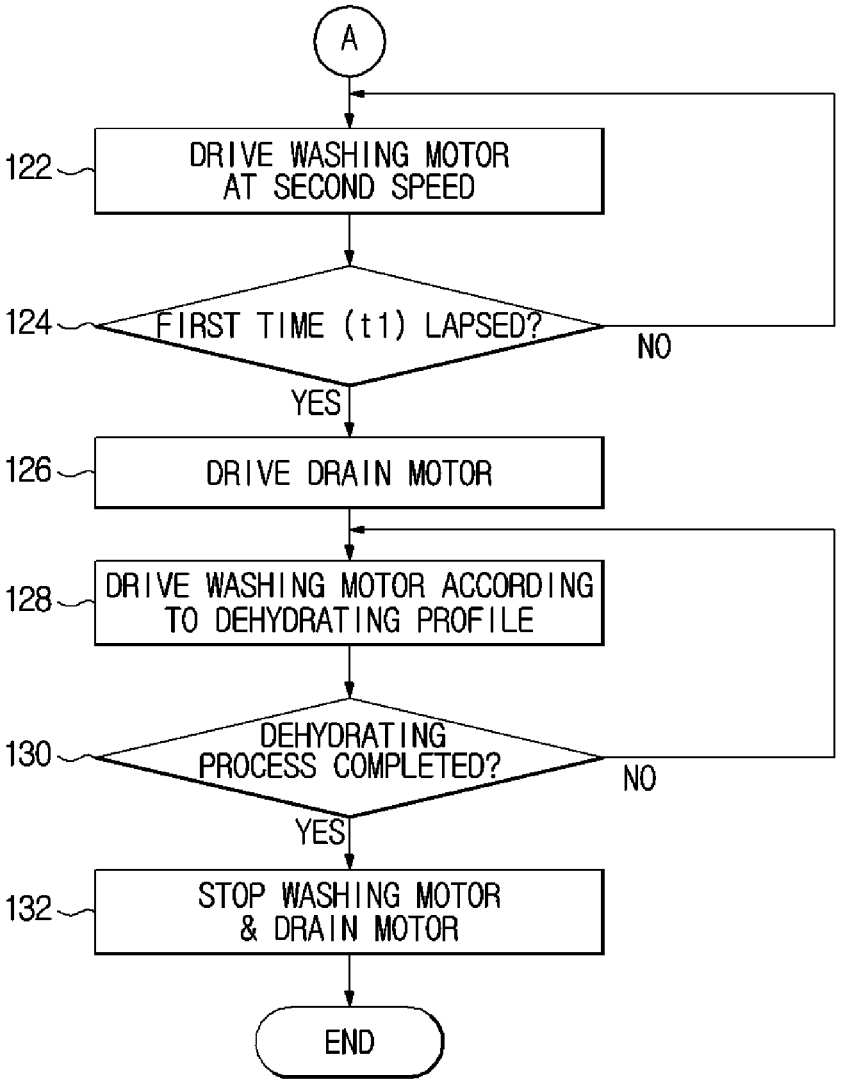

FIGS. 11A and 11B are a first flowchart illustrating a method of controlling vibrations during the dehydrating process of a washing machine having a ball balancer according to an embodiment and related to an algorithm of effectively reducing and vibrations of the tub 11 generated by concentration of the balls 92 and the unbalanced laundry W while entering the dehydrating process.

Figure 12:
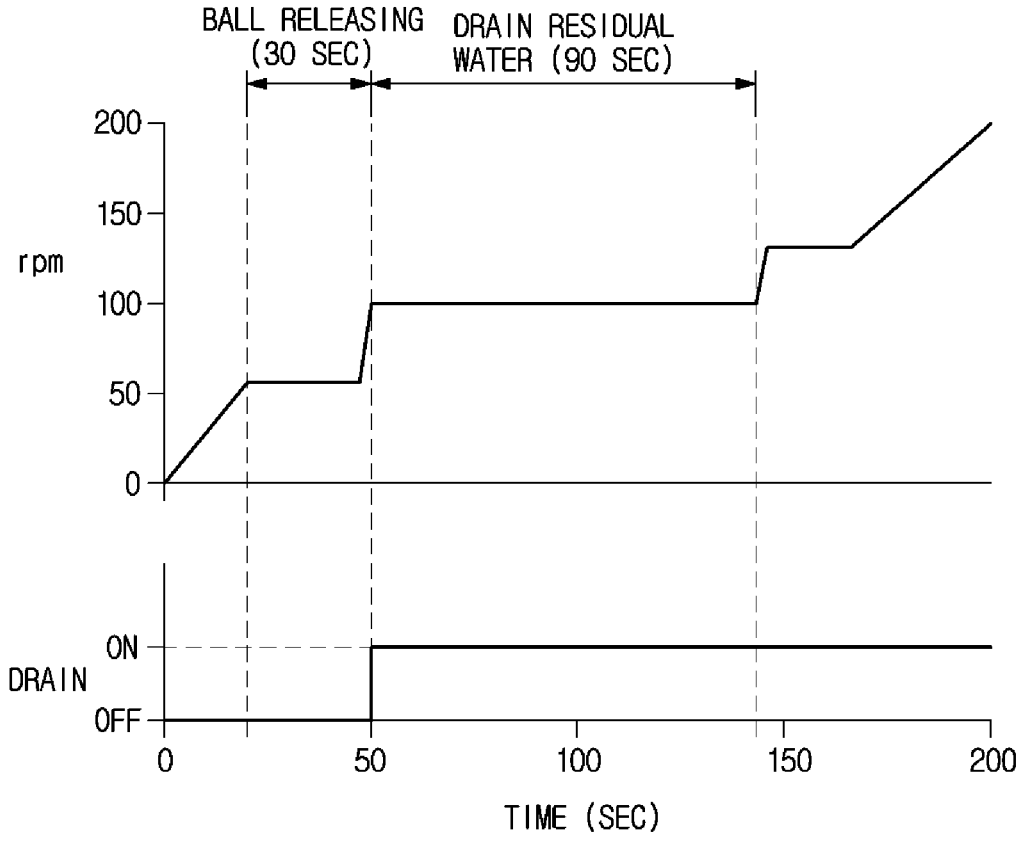
FIG. 12 is a graph illustrating a first motor-driving profile at a dehydrating process of a washing machine having a ball balancer according to an embodiment.

FIG. 12 is a graph illustrating a first motor-driving profile at a dehydrating process of a washing machine having a ball balancer according to an embodiment.

Referring to FIGS. 11A and 11B, when a user selects a washing course (a standard course, a wool course, a delicate course, and etc. of a plurality of washing courses, for example the standard course may be selected according to type of laundry) according to type of laundry by putting laundry into the rotating tub 12 and manipulating buttons of the input unit 70 and operating information such as a function of adding a rinse, the operating information selected by the user is inputted to the control unit 72 through the input unit 70.

Thus, the control unit 72 performs a series of operations to perform the dehydrating process via the washing process and the rinsing process according to the operating information inputted from the input unit 70.

For the control of vibrations in the dehydrating process according to an embodiment, the control unit 72 determines whether it is a washing process or a rinsing process (100) and performs drain operation of draining water within the tub 11 to the outside through the drain tubes 21 and 23 by driving the drain motor 22 through the driving unit 76 when the washing process or the rinsing process is completed (102).

At this time, the control unit 72 detects level of the tub 11 lowering by the draining, that is, level of the water (residual water) remaining in the tub 11 through the level sensor 30 and determines whether the detected level is a first level (level where the unbalanced vibrations caused by the laundry, that is, eccentricity may be detected; about 50 L) (104).

As a result of the determination in operation 104, when the level of the residual water is not the first level, the control unit 72 continues the drain by driving the drain motor 22 (ON) until the level of the residual water reaches the first level.

Meanwhile, as a result of the determination in operation 104, when the level of the residual water reaches the first level, the control unit 72 stops the drain motor 22 through the driving unit 76 (OFF) to stop the drain (106).

Thus, in the lower side of the tub 11, water is not completely drained after the washing process and the rinsing process but the residual water as much as the first level (about 50 L) remains.

As such, when the residual water at the first level (about 50 L) remains in the tub 11, the control unit 72 drives the washing motor 14 through the driving unit 76 at a first speed (a rotating speed of the washing motor lower than the resonant point; about 70 RPM) (108). The eccentricity generated as the washing motor 14 is driven at the first speed, that is, the unbalanced vibrations caused by the unbalanced laundry are detected by the vibration sensor 60 and are transmitted to the control unit 72 (110). The louder the unbalanced vibrations detected by the vibration sensor 60 are the larger the eccentricity is.

Thus, the control unit 72 compares the eccentricity data detected by the vibration sensor 60 with the reference data (data to determine whether the cloth untangling process of shaking and untangling tangled laundry is performed or not) to determine whether the detected data is smaller than the reference data (112).

As a result of the determination in operation 112, when the detected data is smaller than the reference data, the control unit 72 determines that the cloth untangling process is not performed because the eccentricity caused by the unbalanced laundry is small and directly performs the dehydrating process.

Next, the control unit 72, before starting the dehydrating process, sets quantity of the residual water differently according to the eccentricity detected by the vibration sensor 60 (114). Since the larger the eccentricity is the louder the vibrations of the tub 11 are, a great quantity of the residual water as a balance is set to reduce vibrations of the tub 11 as much as possible. In this case, the level of the residual water (height of water surface) may be not higher than the bottom of the pulsator 13 for prevention of bubbles and easy drain. Moreover, the quantity of residual water is different according to size and the shape of the bottom surface of the tub 11, but is set within a range about 5 L to 20 L.

When the quantity of residual water is set differently according to the eccentricity, the control unit 72 drives the drain motor 22 by the driving unit 76 (ON) such that the drain where water within the tub 11 is drained through the drain tubes 21 and 23 (116).

The control unit 72 detects the level of the tub 11 lowering as the drain operation is performed, that is, the level of water remaining in the tub 11 (residual water) through the level sensor 30 and determines whether the detected level is a set level (a level in which the residual water within the tub acts as a balancer to rotate the rotating tub stably; for example, 15 L) (118).

As a result of the determination in operation 118, when the level of the residual water is not the set level, the control unit 72 drives the drain motor 22 to continue the draining operation until the level of the residual water reaches the set level.

Meanwhile, as a result of the determination in operation 118, when the level of the residual water reaches the set level, the control unit 72 stops the drain motor 22 through the driving unit 76 to stop the draining operation (120).

Thus, in the lower side of the tub 11, water is not completely drained after the washing process and the rinsing process but the residual water as much as the set level (about 15 L) remains.

As such, in a state that the residual water at the set level (for example, 15 L) remains, the control unit 72, as illustrated in FIG. 12, drives the washing motor 14 in a direction at a second speed (a rotating speed of the washing motor to release the balls in the ball balancer; about 55 RPM) through the driving unit 76 (122).

When the washing motor 14 is driven at the second speed without draining the water in the tub 11 completely but retaining the residual water at the set level (for example, 15 L), the residual water remaining in the tub 11 acts as a balancer even when the ball balancer 90 does not maintain balance of the rotating tub 12 before the rotating rub 12 rotates faster than a preset speed and reduces vibrations of the tub while passing through the resonant point (a rotating speed of the washing motor at which the vibrations are maximum, about 80 RPM) in the early entering the dehydrating process.

Moreover, the control unit 72 starts to release the balls 92 within the ball balancer 90 not to concentrate by rotating the washing motor 14 at a low speed.

Next, the control unit 72 counts time of driving the washing motor 14 at the second speed in a direction and determines whether the counted time elapses a first preset time t1 (a driving time of the washing motor for releasing the balls within the ball balancer; about 30 seconds) (124).

As a result of the determination in operation 124, when the counted time does not elapse the first preset time t1, the control unit 72 returns back to operation 122 to maintain the rotating speed of the washing motor 14 at the second speed until the counted time elapses the first preset time t1 not to concentrate but release the balls 92 within the ball balancer 90 (See FIG. 12).

As such, the control unit 72 may reduce vibrations of the tub 11 using the weight of the residual water by starting the dehydrating process while retaining the residual water at the set level (about 15 L) during the dehydrating process and release the balls 92 within the ball balancer 90 by maintaining the rotating speed of the washing motor 14 at the second speed (about 55 RPM) while passing through the resonant point (about 80 RPM) for the first preset time t1 (about 30 seconds).

Meanwhile, as a result of the determination in operation 124, when the first preset time t1 has elapsed, the control unit 72, as illustrated in FIG. 12, drives the drain motor 22 through the driving unit 76 again (ON) to start the draining operation of the residual water in the tub 11 (126).

In this case, the drain motor 22 is driven such that drain starts at a region of maintaining the rotating speed of the washing motor 14 at a preset speed (about 100 RPM) after passing the resonant point (about 80 RPM).

The reason why the rotating speed of the washing motor 14 is maintained at a preset speed (about 100 RPM) in the residual water draining region is because the residual water is easily drained simultaneously with the release of the balls.

Meanwhile, the residual water draining time may be different according to volume of the laundry, capacity of the drain motor 22, and size and volume of the washing machine 1.

The control unit 72 performs the dehydrating process to remove moisture contained in the laundry W while draining of the residual water. To this end, the control unit 72, as illustrated in FIG. 12, drives the rotating tub 12 at a high speed by controlling the rotating speed RPM of the washing motor 14 according to a dehydrating profile through the driving unit 76 (128). In this case, since the drain motor 22 maintains the driven state ON, the moisture removed from the laundry W is drained with the residual water.

Next, the control unit 72 determines whether dehydrating process is completed (130), the control unit 72 returns back to operation 128 to accelerate the washing motor 14 at a preset rotating speed (a dehydrating speed) according to the dehydrating profile when the dehydrating process is not completed.

As such, the residual water is drained after passing through the resonant point and the rotating speed of the washing motor 14 is accelerated according to the preset dehydrating profile to reduce the drain noise and decrease the dehydrating time.

Meanwhile, as a result of the determination in operation 130, when the dehydrating process is completed, the control unit 72 stops the washing motor 14 and the drain motor 22 through the driving unit 76 and finishes the dehydrating (132).

Moreover, as a result of the determination in operation 212, when the detected data is not smaller than the reference data, the control unit 72 determines that the eccentricity caused by the unbalanced laundry is large and the cloth untangling process may be performed, performs the cloth untangling process without entering the dehydrating process (140), and returns back to operation 108 to perform next operations.

In the cloth untangling process, the washing motor 14 is rotated at a preset target RPM (about 90 RPM to 130 RPM) in the forward direction or in the reverse direction to pulsate the pulsator 14 clockwise and counterclockwise. By doing so, the laundry accommodated in the rotating tub 12 is shaken and untangled so that the laundry is evenly distributed in the rotating tub 12.

Figure 13A:
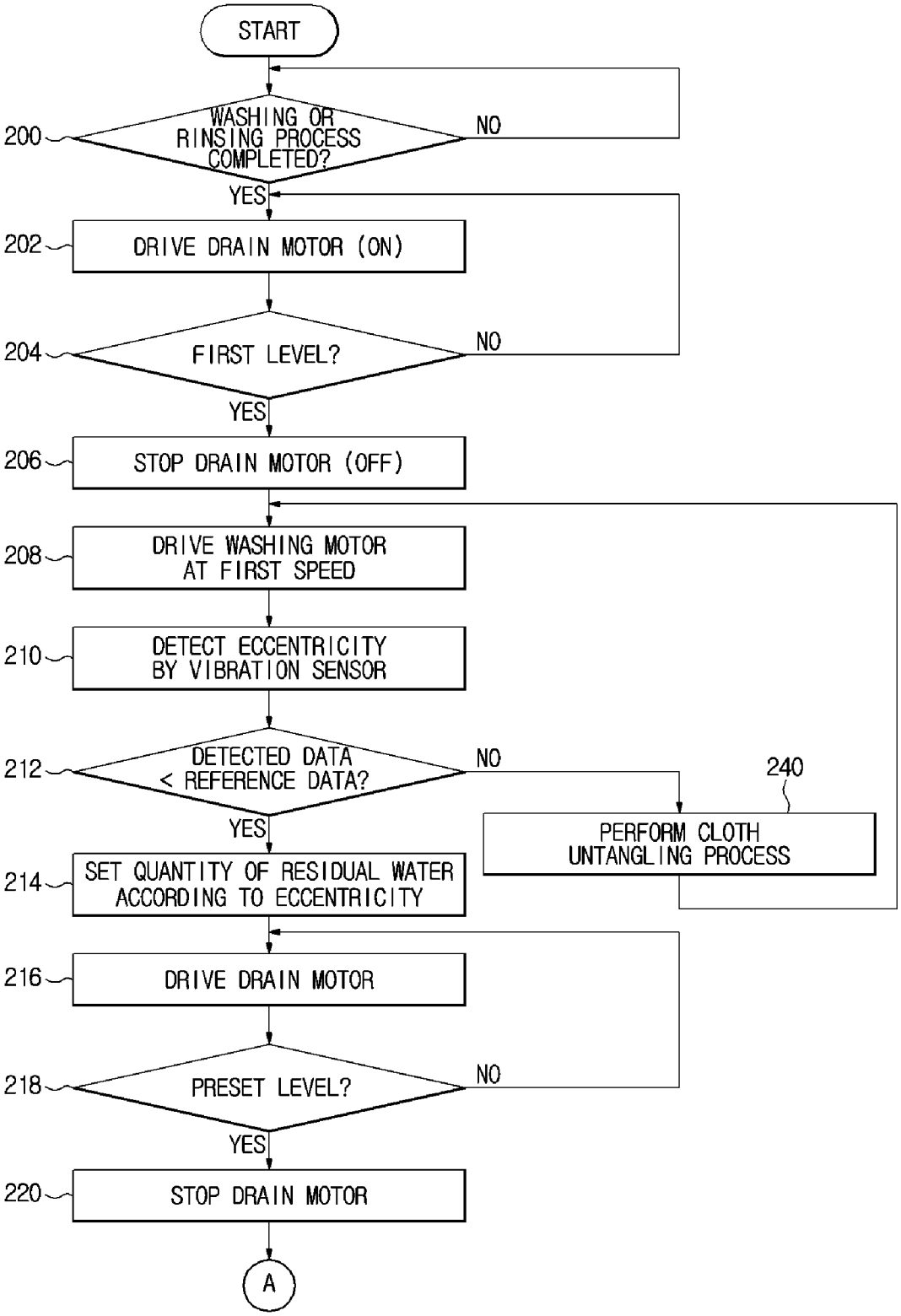
FIGS. 13A and 13B are a second flowchart illustrating a method of controlling vibrations during the dehydrating process of a washing machine having a ball balancer according to an embodiment.
Figure 13B:
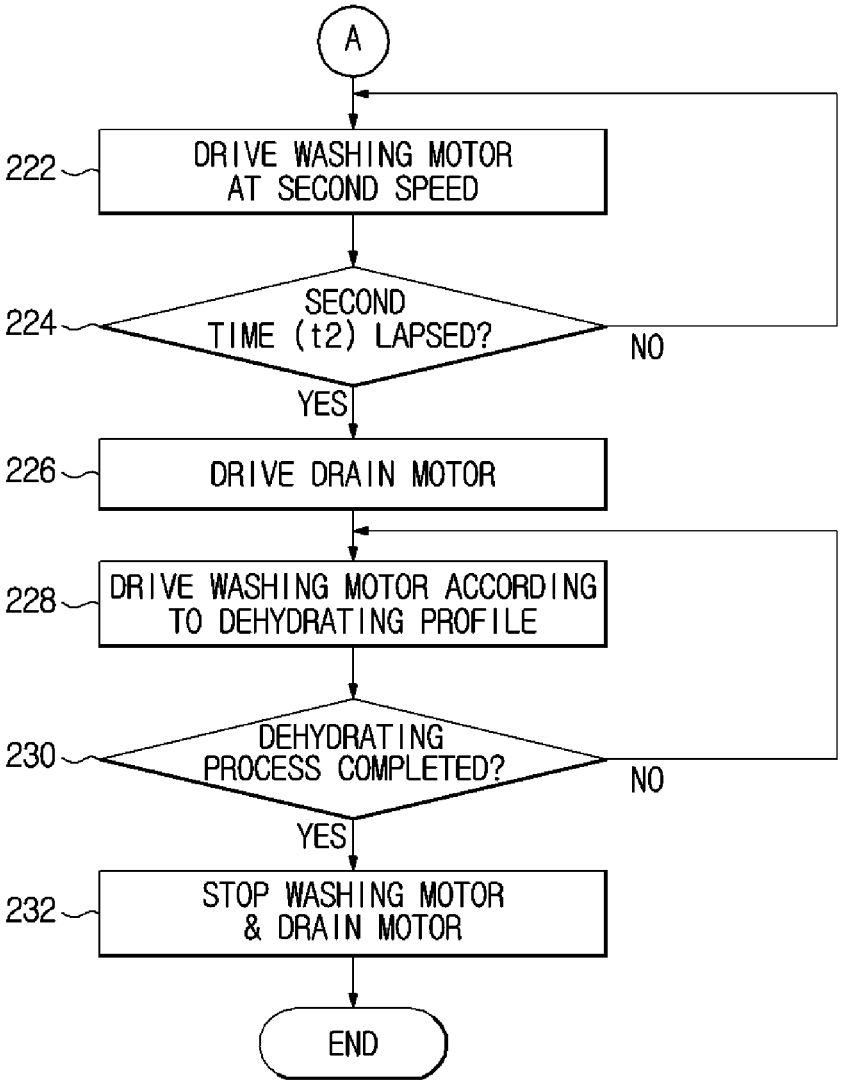

FIGS. 13A and 13B are a second flowchart illustrating a method of controlling vibrations during the dehydrating process of a washing machine having a ball balancer according to an embodiment, and related to an algorithm of effectively reducing and vibrations of the tub 11 generated by concentration of the balls 92 and the unbalanced laundry W while entering the dehydrating process.

Figure 14:
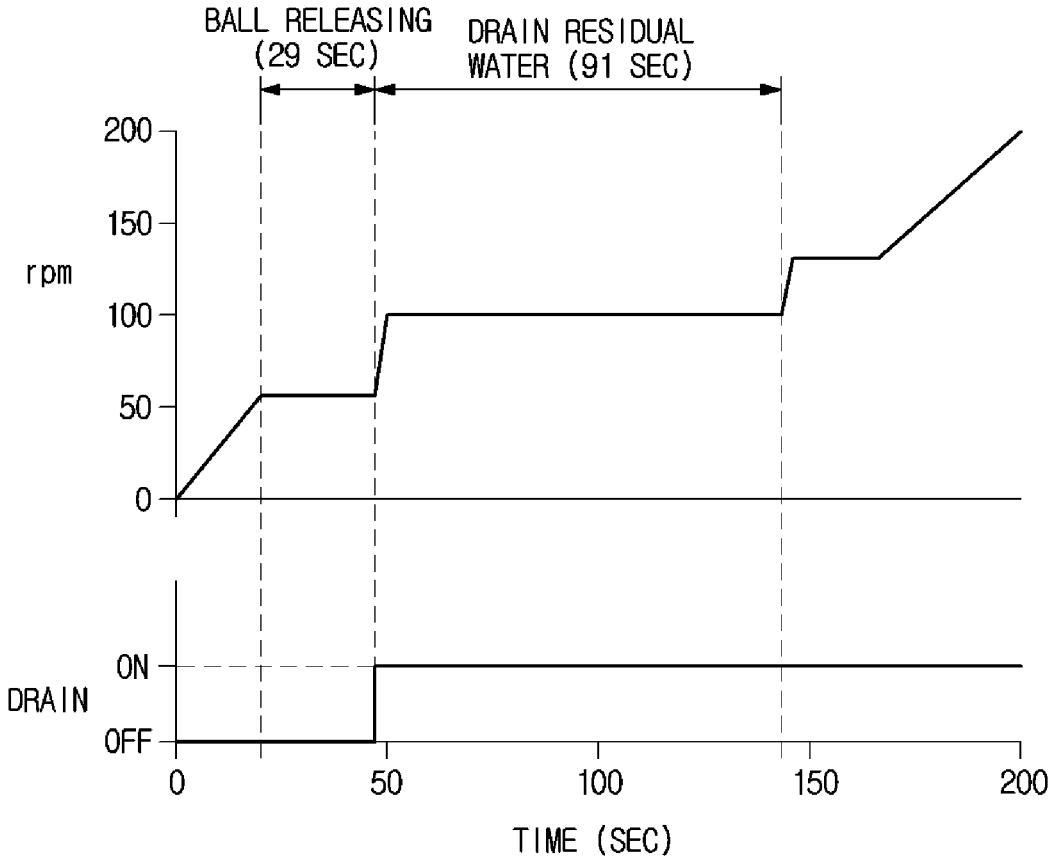
FIG. 14 is a graph illustrating a second motor-driving profile at a dehydrating process of a washing machine having a ball balancer according to an embodiment.

FIG. 14 is a graph illustrating a second motor-driving profile at a dehydrating process of a washing machine having a ball balancer according to an embodiment.

In FIGS. 13A and 13B, when a user puts laundry into the rotating tub 12, manipulates buttons of the input unit 70 to select operating information such as a washing course and a rinsing course according to type of the laundry, the operating information selected by the user is inputted to the control unit 72 through the input unit 70.

Thus, the control unit 72 performs a series of operations to perform the dehydrating process via the washing process and the rinsing process according to the operating information inputted from the input unit 70. For the control of vibrations in the dehydrating process, the control unit 72 determines whether it is a washing process or a rinsing process (200).

As a result of the determination in operation 200, when the washing process or the rinsing process is completed, the control unit 72 performs drain operation of draining water within the tub 11 to the outside through the drain tubes 21 and 23 by driving the drain motor 22 through the driving unit 76 (202).

At this time, the control unit 72 detects level of the tub 11 lowering by the draining, that is, level of the water (residual water) remaining in the tub 11 through the level sensor 30 and determines whether the detected level is a first level (204).

As a result of the determination in operation 204, when the level of the residual water is not the first level, the control unit 72 continues the drain by driving the drain motor 22 (ON) until the level of the residual water reaches the first level.

Meanwhile, as a result of the determination in operation 204, when the level of the residual water reaches the first level, the control unit 72 stops the drain motor 22 through the driving unit 76 (OFF) to stop the drain (206).

Thus, in the lower side of the tub 11, water is not completely drained after the washing process and the rinsing process but the residual water as much as the first level (about 50 L) remains.

As such, when the residual water at the first level (about 50 L) remains in the tub 11, the control unit 72 drives the washing motor 14 through the driving unit 76 at a first speed (a rotating speed of the washing motor lower than the resonant point; about 70 RPM) (208). The eccentricity generated as the washing motor 14 is driven at the first speed is detected by the vibration sensor 60 and is transmitted to the control unit 72 (210).

Thus, the control unit 72 compares the eccentricity data detected by the vibration sensor 60 with the reference data to determine whether the detected data is smaller than the reference data (212).

As a result of the determination in operation 212, when the detected data is smaller than the reference data, the control unit 72 determines that the cloth untangling process is not performed because the eccentricity caused by the unbalanced laundry is small and directly performs the dehydrating process.

Next, the control unit 72, before starting the dehydrating process, sets quantity of the residual water differently according to the eccentricity detected by the vibration sensor 60 (214).

When the quantity of residual water is set according to the eccentricity, the control unit 72 drives the drain motor 22 by the driving unit 76 (ON) such that the drain where water within the tub 11 is drained through the drain tubes 21 and 23 is performed (216).

The control unit 72 detects the level of the tub 11 lowering as the drain operation is performed, that is, the level of water remaining in the tub 11 (residual water) through the level sensor 30 and determines whether the detected level is a set level (218).

As a result of the determination in operation 218, when the level of the residual water is not the set level, the control unit 72 drives the drain motor 22 to continue the draining operation until the level of the residual water reaches the set level.

Meanwhile, as a result of the determination in operation 218, when the level of the residual water reaches the set level, the control unit 72 stops the drain motor 22 through the driving unit 76 to stop the draining operation (220).

Thus, in the state that the residual water as much as the set level (about 15 L) remains in the tub 11, the control unit 72, as illustrated in FIG. 14, drives the washing motor 14 in a direction at a second speed through the driving unit 76 (222).

When the washing motor 14 is driven at the second speed without draining the water in the tub 11 completely but retaining the residual water at the set level (for example, 15 L), the residual water remaining in the tub 11 acts as a balancer even when the ball balancer 90 does not maintain balance of the rotating tub 12 before the rotating rub 12 rotates faster than a preset speed and reduces vibrations of the tub while passing through the resonant point in the early entering the dehydrating process.

Next, the control unit 72 counts time of driving the washing motor 14 at the second speed in a direction and determines whether the counted time elapses a second preset time t2 (a driving time of the washing motor for releasing the balls within the ball balancer; about 29 seconds) (224).

As a result of the determination in operation 224, when the counted time does not elapse the second preset time t2, the control unit 72 returns back to operation 222 to maintain the rotating speed of the washing motor 14 at the second speed until the counted time elapses the second preset time t2 not to concentrate but release the balls 92 within the ball balancer 90 (See FIG. 14).

As such, the control unit 72 may reduce vibrations of the tub 11 using the weight of the residual water by starting the dehydrating process while retaining the residual water at the set level (about 15 L) during the dehydrating process and release the balls 92 within the ball balancer 90 by maintaining the rotating speed of the washing motor 14 at the second speed (about 55 RPM) while passing through the resonant point (about 80 RPM) for the second preset time t2 (about 29 seconds).

Meanwhile, as a result of the determination in operation 224, when the second preset time t2 has elapsed, the control unit 72, as illustrated in FIG. 14, drives the drain motor 22 through the driving unit 76 again (ON) to start the draining operation of the residual water in the tub 11 (226).

In this case, the drain motor 22 is driven such that drain starts at a region of maintaining the rotating speed of the washing motor 14 at a preset speed (about 55 RPM) after passing through the resonant point (about 80 RPM).

The control unit 72 performs the dehydrating process to remove moisture contained in the laundry W while draining of the residual water. To this end, the control unit 72, as illustrated in FIG. 14, drives the rotating tub 12 at a high speed by controlling the rotating speed RPM of the washing motor 14 according to a dehydrating profile through the driving unit 76 (228). In this case, since the drain motor 22 maintains the driven state ON, the moisture removed from the laundry W is drained with the residual water.

Next, the control unit 72 determines whether dehydrating process is completed (230), the control unit 72 returns back to operation 228 to accelerate the washing motor 14 at a preset rotating speed (a dehydrating speed) according to the dehydrating profile when the dehydrating process is not completed.

As such, the residual water is drained after passing through the resonant point and the rotating speed of the washing motor 14 is accelerated according to the preset dehydrating profile to reduce the drain noise and decrease the dehydrating time.

Meanwhile, as a result of the determination in operation 230, when the dehydrating process is completed, the control unit 72 stops the washing motor 14 and the drain motor 22 through the driving unit 76 and finishes the dehydrating (232).

Moreover, as a result of the determination in operation 212, when the detected data is not smaller than the reference data, the control unit 72 determines that the eccentricity caused by the unbalanced laundry is large and the cloth untangling process may be performed, performs the cloth untangling process without entering the dehydrating process (240), and returns back to operation 208 to perform next operations.

Figure 15A:
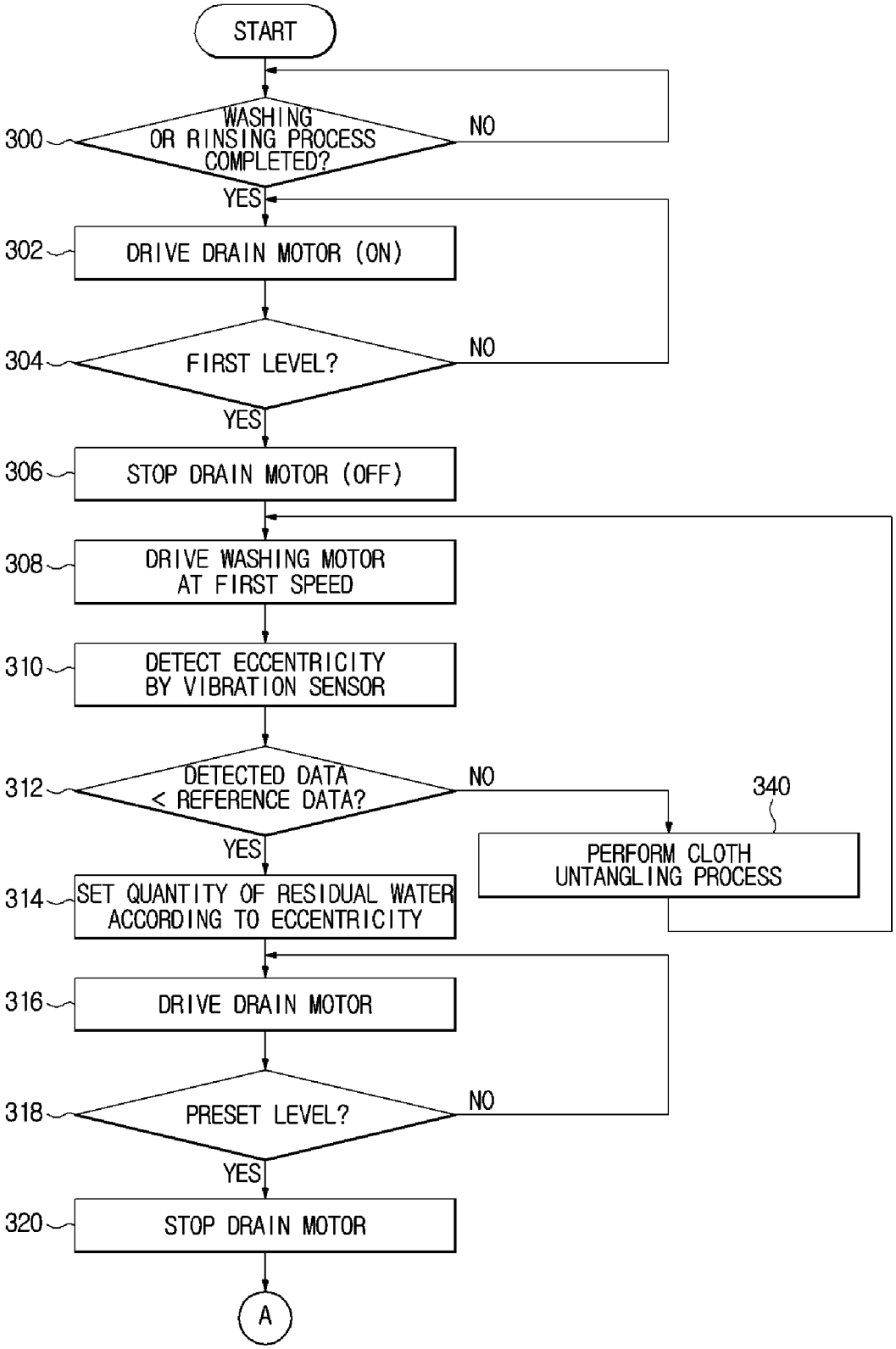
FIGS. 15A and 15B are a third flowchart illustrating a method of controlling vibrations during the dehydrating process of a washing machine having a ball balancer according to an embodiment.
Figure 15B:
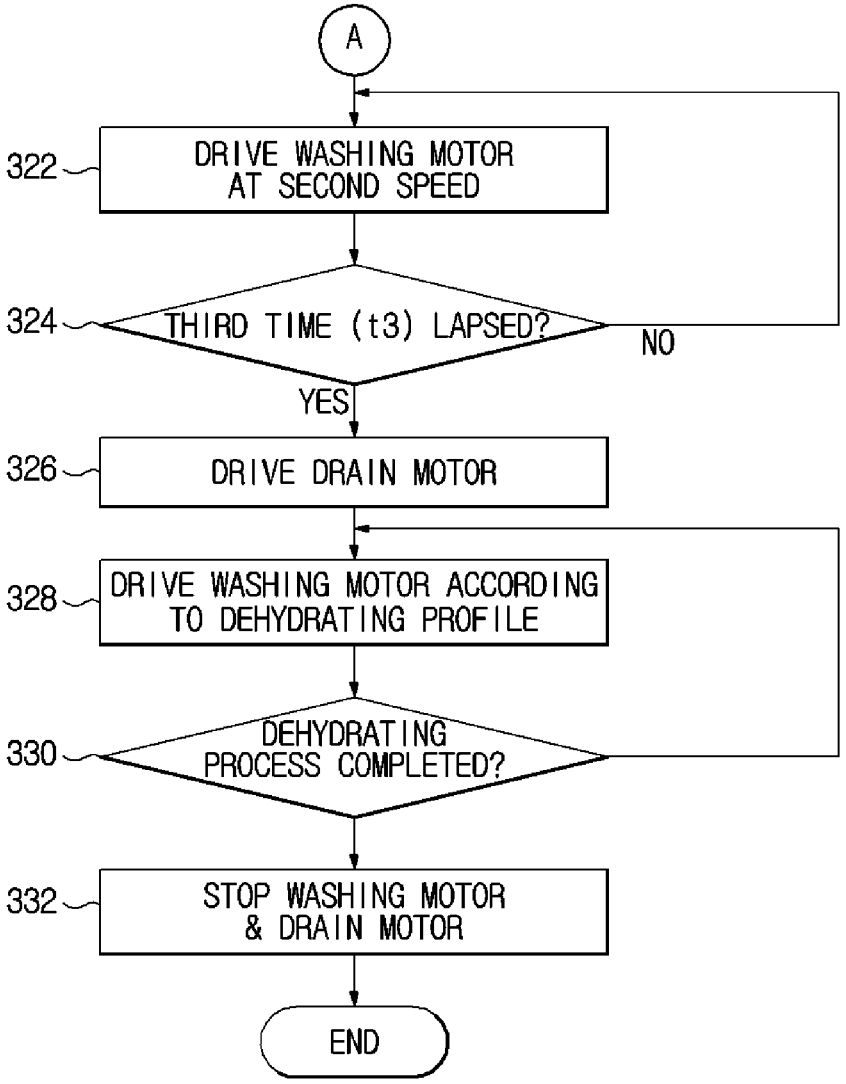

FIGS. 15A and 15B are a third flowchart illustrating a method of controlling vibrations during the dehydrating process of a washing machine having a ball balancer according to an embodiment, and related to an algorithm of effectively reducing and vibrations of the tub 11 generated by concentration of the balls 92 and the unbalanced laundry W while entering the dehydrating process.

Figure 16:
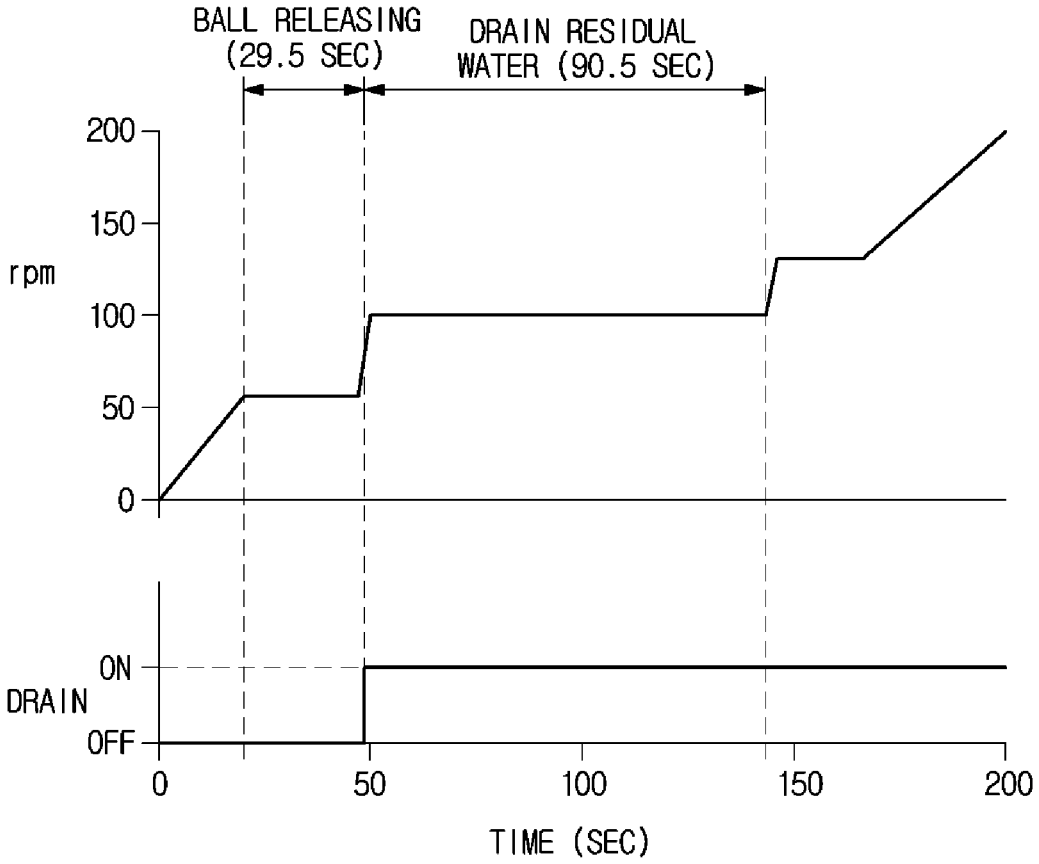
FIG. 16 is a graph illustrating a third motor-driving profile at a dehydrating process of a washing machine having a ball balancer according to an embodiment.

FIG. 16 is a graph illustrating a third motor-driving profile at a dehydrating process of a washing machine having a ball balancer according to an embodiment.

In FIGS. 15A and 15B, when a user puts laundry into the rotating tub 12, manipulates buttons of the input unit 70 to select operating information such as a washing course and a rinsing course according to type of the laundry, the operating information selected by the user is inputted to the control unit 72 through the input unit 70.

Thus, the control unit 72 performs a series of operations to perform the dehydrating process via the washing process and the rinsing process according to the operating information inputted from the input unit 70. For the control of vibrations in the dehydrating process, the control unit 72 determines whether it is a washing process or a rinsing process (300).

As a result of the determination in operation 300, when the washing process or the rinsing process is completed, the control unit 72 performs drain operation of draining water within the tub 11 to the outside through the drain tubes 21 and 23 by driving the drain motor 22 through the driving unit 76 (302).

At this time, the control unit 72 detects level of the tub 11 lowering by the draining, that is, level of the water (residual water) remaining in the tub 11 through the level sensor 30 and determines whether the detected level is a first level (304).

As a result of the determination in operation 304, when the level of the residual water is not the first level, the control unit 72 continues the drain by driving the drain motor 22 (ON) until the level of the residual water reaches the first level.

Meanwhile, as a result of the determination in operation 304, when the level of the residual water reaches the first level, the control unit 72 stops the drain motor 22 through the driving unit 76 (OFF) to stop the drain (306).

Thus, in the lower side of the tub 11, water is not completely drained after the washing process and the rinsing process but the residual water as much as the first level (about 50 L) remains.

As such, when the residual water at the first level (about 50 L) remains in the tub 11, the control unit 72 drives the washing motor 14 through the driving unit 76 at a first speed (a rotating speed of the washing motor lower than the resonant point; about 70 RPM) (308). The eccentricity generated as the washing motor 14 is driven at the first speed is detected by the vibration sensor 60 and is transmitted to the control unit 72 (310).

Thus, the control unit 72 compares the eccentricity data detected by the vibration sensor 60 with the reference data to determine whether the detected data is smaller than the reference data (312).

As a result of the determination in operation 312, when the detected data is smaller than the reference data, the control unit 72 determines that the cloth untangling process is not performed because the eccentricity caused by the unbalanced laundry is small and directly performs the dehydrating process.

Next, the control unit 72, before starting the dehydrating process, sets quantity of the residual water differently according to the eccentricity detected by the vibration sensor 60 (314).

When the quantity of residual water is set according to the eccentricity, the control unit 72 drives the drain motor 22 by the driving unit 76 (ON) such that the drain where water within the tub 11 is drained through the drain tubes 21 and 23 is performed (316).

The control unit 72 detects the level of the tub 11 lowering as the drain operation is performed, that is, the level of water remaining in the tub 11 (residual water) through the level sensor 30 and determines whether the detected level is a set level (318).

As a result of the determination in operation 318, when the level of the residual water is not the set level, the control unit 72 drives the drain motor 22 to continue the draining operation until the level of the residual water reaches the set level.

Meanwhile, as a result of the determination in operation 318, when the level of the residual water reaches the set level, the control unit 72 stops the drain motor 22 through the driving unit 76 to stop the draining operation (320).

Thus, in the state that the residual water as much as the set level (about 15 L) remains in the tub 11, the control unit 72, as illustrated in FIG. 16, drives the washing motor 14 in a direction at a second speed through the driving unit 76 (322).

When the washing motor 14 is driven at the second speed without draining the water in the tub 11 completely but retaining the residual water at the set level (for example, 15 L), the residual water remaining in the tub 11 acts as a balancer even when the ball balancer 90 does not maintain balance of the rotating tub 12 before the rotating rub 12 rotates faster than a preset speed and reduces vibrations of the tub while passing through the resonant point in the early entering the dehydrating process.

Next, the control unit 72 counts time of driving the washing motor 14 at the second speed in a direction and determines whether the counted time elapses a third preset time t3 (a driving time of the washing motor for releasing the balls within the ball balancer; about 29.5 seconds) (324).

As a result of the determination in operation 324, when the counted time does not elapse the third preset time t3, the control unit 72 returns back to operation 322 to maintain the rotating speed of the washing motor 14 at the second speed until the counted time elapses the third preset time t3 not to concentrate but release the balls 92 within the ball balancer 90 (See FIG. 16).

As such, the control unit 72 may reduce vibrations of the tub 11 using the weight of the residual water by starting the dehydrating process while retaining the residual water at the set level (about 15 L) during the dehydrating process and release the balls 92 within the ball balancer 90 by maintaining the rotating speed of the washing motor 14 at the second speed (about 55 RPM) while passing through the resonant point (about 80 RPM) for the third preset time t3 (about 29.5 seconds).

Meanwhile, as a result of the determination in operation 324, when the third preset time t3 has elapsed, the control unit 72, as illustrated in FIG. 16, drives the drain motor 22 through the driving unit 76 again (ON) to start the draining operation of the residual water in the tub 11 (326).

In this case, the drain motor 22 is driven such that drain starts when passing through the resonant point (about 80 RPM).

The control unit 72 performs the dehydrating process to remove moisture contained in the laundry W while draining of the residual water. To this end, the control unit 72, as illustrated in FIG. 16, drives the rotating tub 12 at a high speed by controlling the rotating speed RPM of the washing motor 14 according to a dehydrating profile through the driving unit 76 (328). In this case, since the drain motor 22 maintains the driven state ON, the moisture removed from the laundry W is drained with the residual water.

Next, the control unit 72 determines whether dehydrating process is completed (330), the control unit 72 returns back to operation 328 to accelerate the washing motor 14 at a preset rotating speed (a dehydrating speed) according to the dehydrating profile when the dehydrating process is not completed.

As such, the residual water is drained after passing through the resonant point and the rotating speed of the washing motor 14 is accelerated according to the preset dehydrating profile to reduce the drain noise and decrease the dehydrating time.

Meanwhile, as a result of the determination in operation 330, when the dehydrating process is completed, the control unit 72 stops the washing motor 14 and the drain motor 22 through the driving unit 76 and finishes the dehydrating (332).

Moreover, as a result of the determination in operation 312, when the detected data is not smaller than the reference data, the control unit 72 determines that the eccentricity caused by the unbalanced laundry is large and the cloth untangling process may be performed, performs the cloth untangling process without entering the dehydrating process (340), and returns back to operation 308 to perform next operations.

FIG. 1 illustrates the ball balancer 90 as being installed at the upper side of the rotating tub 12 but the present embodiment is not limited thereto. The present embodiment may be achieved even in a case when the ball balancer 90 is installed at the lower side of the rotating tub 12 or at the upper and lower side. This will be described with reference to FIGS. 17 and 19.

First, a case when the ball balancer 90 is installed in the lower side of the rotating tub 12 will be described with reference to FIGS. 17, 18A, and 18B.

Figure 17:
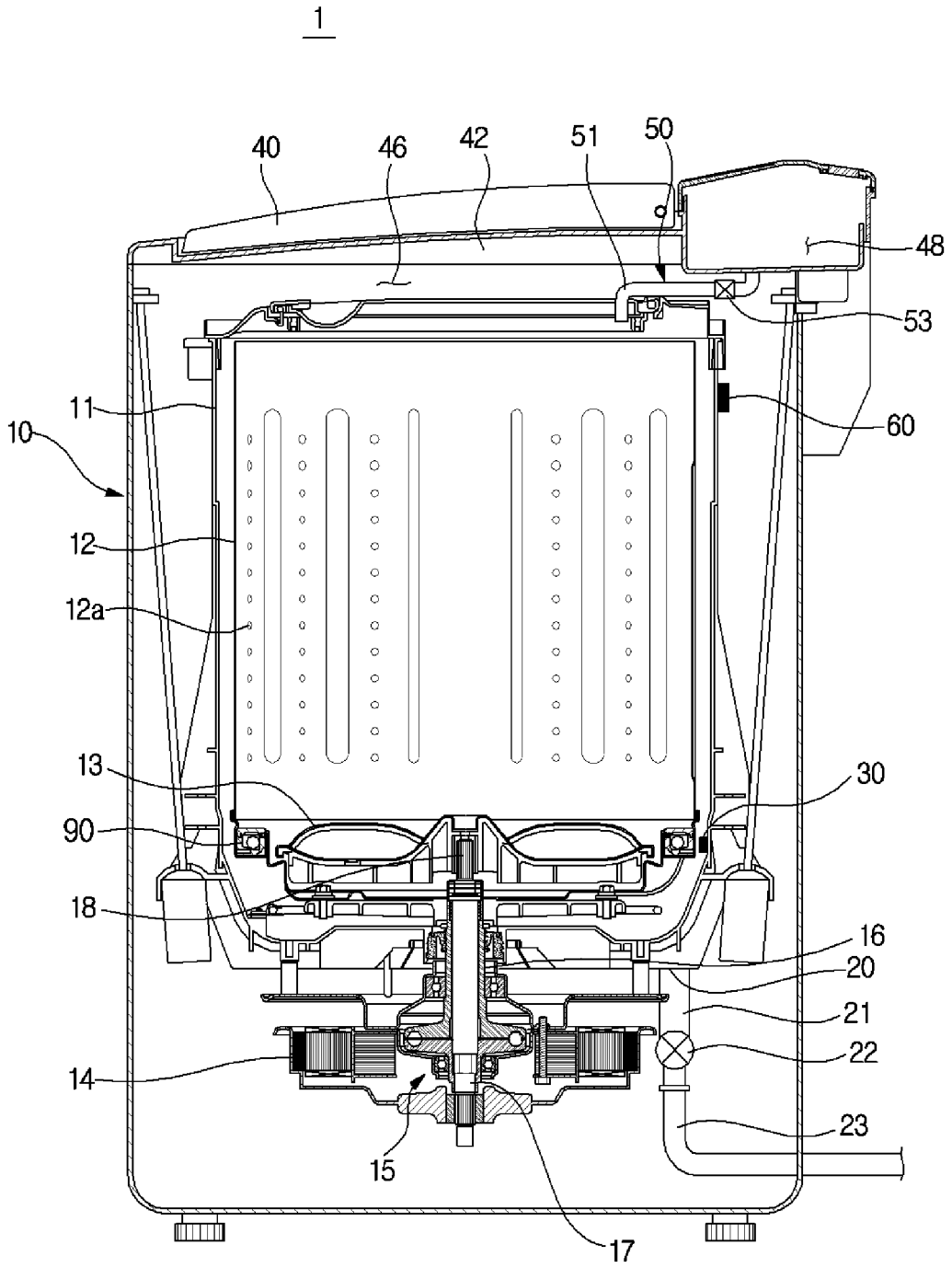
FIG. 17 is a sectional view illustrating a washing machine having a ball balancer according to another embodiment.
Figure 18A:
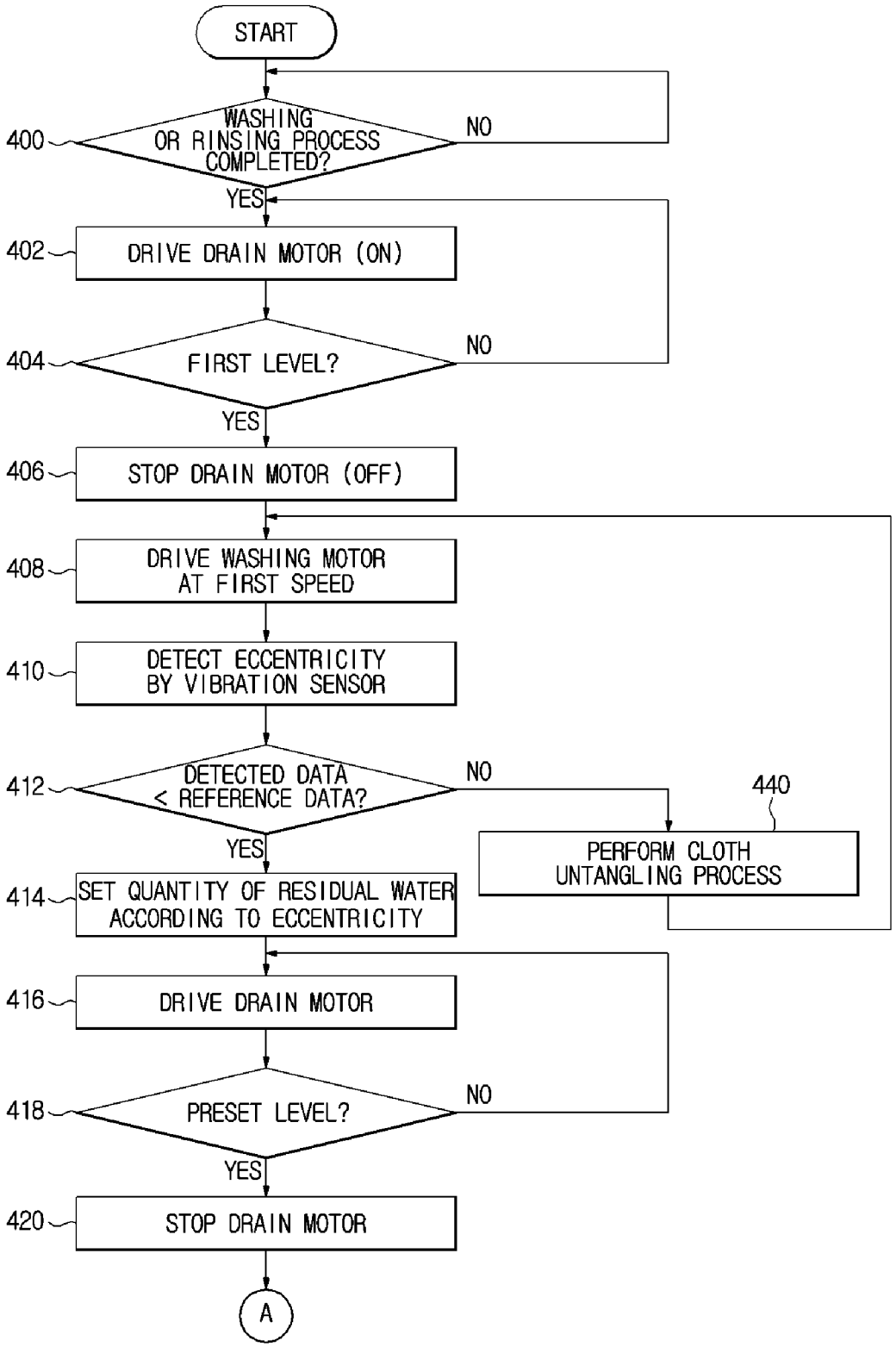
FIGS. 18A and 18B are a flowchart illustrating a method of controlling vibrations during the dehydrating process of a washing machine as shown in FIG. 17.
Figure 18B:
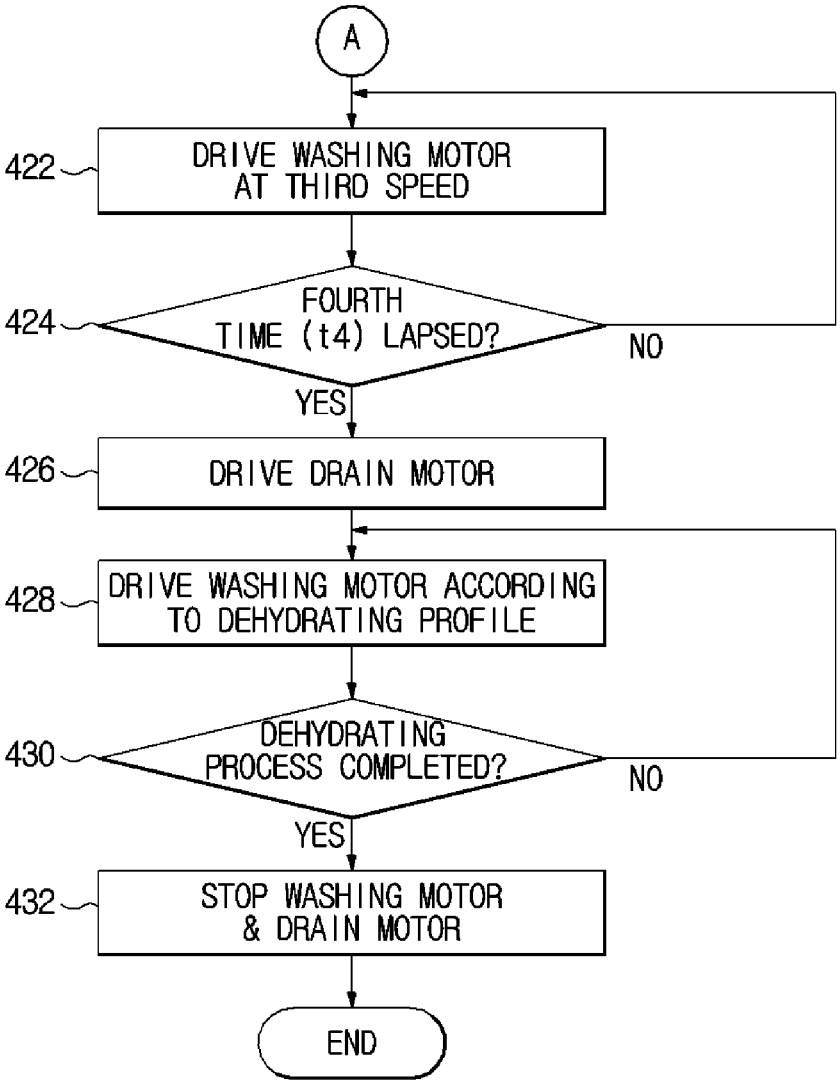

Before the description of FIGS. 17, 18A, and 18B, same reference numerals and notations are used to same elements as those of FIGS. 1, 11A, and 11B and duplicated descriptions will be omitted.

FIG. 17 is a sectional view illustrating a washing machine having a ball balancer according to another embodiment.

As illustrated in FIG. 17, in a washing machine 1 according to another embodiment, a ball balancer 90 is installed at the lower side of the rotating tub 12.

Since, in a case when the ball balancer 90 is installed at the lower side of the rotating tub 12, the resonant point (about higher than 80 RPM) at which the excessive vibrations of the tub 11 are generated in comparison to the case when the ball balancer 90 is installed at the upper side, the rotating speed of the washing motor 14 is set to a second speed (about 60 RPM) higher than the first speed.

Moreover, since, in a case when the ball balancer 90 is installed at the lower side, balancing of the rotating tub 12 may be maintained within a shorter time than a case when the ball balancer 90 is installed at the upper side, the driving time of the washing motor 14 is set to a second time (about 30 seconds) shorter than the first time to perform a ball releasing process of releasing balls 92 in the ball balancer 90. This will be described with reference to FIGS. 18A and 18B.

FIGS. 18A and 18B are a flowchart illustrating a method of controlling vibrations during the dehydrating process of a washing machine as shown in FIG. 17, and related to an algorithm of effectively reducing and vibrations of the tub 11 generated by concentration of the balls 92 and the unbalanced laundry W while entering the dehydrating process.

In FIGS. 18A and 18B, a user puts laundry into the rotating tub 12, manipulates buttons of the input unit 70 and selects operating information such as a washing course and a rinsing course according to type of the laundry. Thus, the operating information selected by the user is inputted to the control unit 72 through the input unit 70.

The control unit 72 performs a series of operations to perform the dehydrating process via the washing process and the rinsing process according to the operating information inputted from the input unit 70. For the control of vibrations in the dehydrating process, the control unit 72 determines whether a washing process or a rinsing process is completed (400).

As a result of the determination in operation 400, when the washing process or the rinsing process is completed, the control unit 72 performs drain operation of draining water within the tub 11 to the outside through the drain tubes 21 and 23 by driving the drain motor 22 through the driving unit 76 (402).

At this time, the control unit 72 detects level of the tub 11 lowering by the draining, that is, level of the water (residual water) remaining in the tub 11 through the level sensor 30 and determines whether the detected level is a first level (404).

As a result of the determination in operation 404, when the level of the residual water is not the first level, the control unit 72 continues the drain by driving the drain motor 22 (ON) until the level of the residual water reaches the first level.

Meanwhile, as a result of the determination in operation 404, when the level of the residual water reaches the first level, the control unit 72 stops the drain motor 22 through the driving unit 76 (OFF) to stop the drain (406).

Thus, when the residual water at the first level (about 50 L) remains in the tub 11, the control unit 72 drives the washing motor 14 through the driving unit 76 at a first speed (a rotating speed of the washing motor lower than the resonant point; about 70 RPM) (408). The eccentricity generated as the washing motor 14 is driven at the first speed is detected by the vibration sensor 60 and is transmitted to the control unit 72 (410).

Thus, the control unit 72 compares the eccentricity data detected by the vibration sensor 60 with the reference data to determine whether the detected data is smaller than the reference data (412).

As a result of the determination in operation 412, when the detected data is smaller than the reference data, the control unit 72, before starting the dehydrating process, sets quantity of the residual water differently according to the eccentricity detected by the vibration sensor 60 (414).

When the quantity of residual water is set according to the eccentricity, the control unit 72 drives the drain motor 22 by the driving unit 76 (ON) such that the drain where water within the tub 11 is drained through the drain tubes 21 and 23 is performed (416).

The control unit 72 detects the level of the tub 11 lowering as the drain operation is performed, that is, the level of water remaining in the tub 11 (residual water) through the level sensor 30 and determines whether the detected level is a set level (418).

As a result of the determination in operation 418, when the level of the residual water is not the set level, the control unit 72 drives the drain motor 22 to continue the draining operation until the level of the residual water reaches the set level.

Meanwhile, as a result of the determination in operation 418, when the level of the residual water reaches the set level, the control unit 72 stops the drain motor 22 through the driving unit 76 to stop the draining operation (420).

Thus, in the state that the residual water as much as the set level (about 15 L) determined according to the eccentricity remains in the tub 11, the control unit 72 drives the washing motor 14 in a direction at a third speed (a rotating speed of the washing motor to release the balls in the ball balancer; about 60 RPM) through the driving unit 76 (422).

When the washing motor 14 is driven at the third speed without draining the water in the tub 11 completely but retaining the residual water at the set level (for example, 15 L), the residual water remaining in the tub 11 acts as a balancer even when the ball balancer 90 does not maintain balance of the rotating tub 12 before the rotating rub 12 rotates faster than a preset speed and reduces vibrations of the tub while passing through the resonant point (a rotating speed of the washing motor at which vibrations of the tub are maximum; about 80 RPM) in the early entering the dehydrating process.

Next, the control unit 72 counts time of driving the washing motor 14 at the third speed in a direction and determines whether the counted time elapses a fourth preset time t4 (a driving time of the washing motor for releasing the balls within the ball balancer; about less than 30 seconds) (424).

As a result of the determination in operation 424, when the counted time does not elapse the fourth preset time t4, the control unit 72 returns back operation 422 to maintain the rotating speed of the washing motor 14 at the third speed until the counted time elapses the fourth preset time t4 not to concentrate but release the balls 92 within the ball balancer 90.

As such, the control unit 72 may reduce vibrations of the tub 11 using the weight of the residual water by starting the dehydrating process while retaining the residual water at the set level (about 15 L) during the dehydrating process and release the balls 92 within the ball balancer 90 by maintaining the rotating speed of the washing motor 14 at the third speed (about 60 RPM) while passing through the resonant point (about 80 RPM) for the fourth preset time t4 (about less than 30 seconds).

Meanwhile, as a result of the determination in operation 424, when the fourth preset time t4 has elapsed, the control unit 72 drives the drain motor 22 through the driving unit 76 again (ON) to start the draining operation of the residual water in the tub 11 (426).

The control unit 72 performs the dehydrating process to remove moisture contained in the laundry W while draining of the residual water. To this end, the control unit 72, as illustrated in FIG. 16, drives the rotating tub 12 at a high speed by controlling the rotating speed RPM of the washing motor 14 according to a dehydrating profile through the driving unit 76 (428). In this case, since the drain motor 22 maintains the driven state ON, the moisture removed from the laundry W is drained with the residual water.

Next, the control unit 72 determines whether dehydrating process is completed (430), the control unit 72 returns back to operation 428 to accelerate the washing motor 14 at a preset rotating speed (a dehydrating speed) according to the dehydrating profile when the dehydrating process is not completed.

After passing through the resonant point, the residual water is drained and the rotating speed of the washing motor 14 is accelerated according to the preset dehydrating profile to reduce the drain noise and decrease the dehydrating time.

Meanwhile, as a result of the determination in operation 430, when the dehydrating process is completed, the control unit 72 stops the washing motor 14 and the drain motor 22 through the driving unit 76 and finishes the dehydrating (432).

Moreover, as a result of the determination in operation 412, when the detected data is not smaller than the reference data, the control unit 72 determines that the eccentricity caused by the unbalanced laundry is large and the cloth untangling process may be performed, performs the cloth untangling process without entering the dehydrating process (440), and returns back to operation 408 to perform next operations.

Next, a case when the ball balancers 90 are installed at the upper and lower sides of the rotating tub 12 will be described with reference to FIGS. 19, 20A, and 20B.

Figure 19:
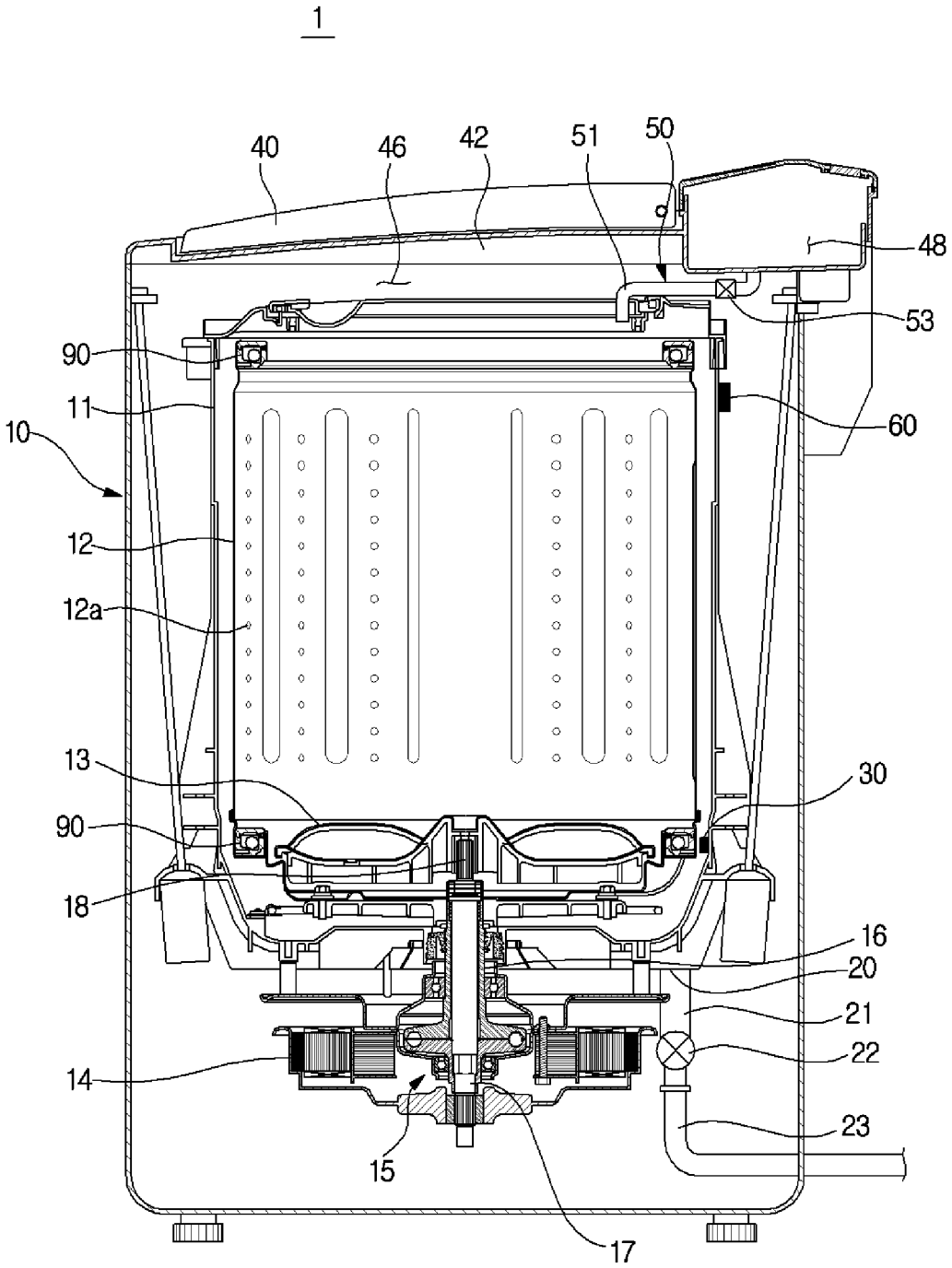
FIG. 19 is a sectional view illustrating a washing machine having a ball balancer according to still another embodiment.
Figure 20A:
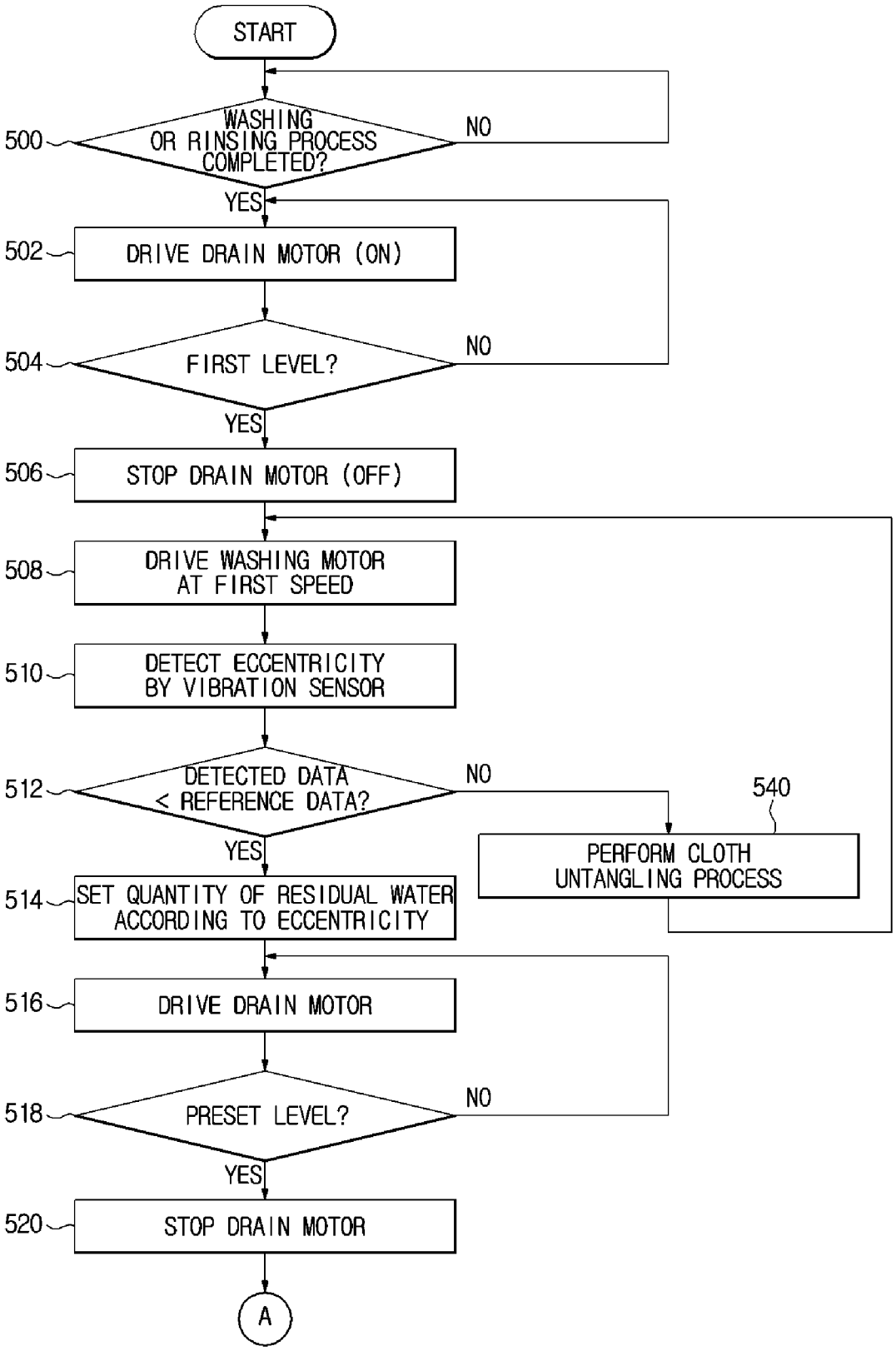
FIGS. 20A and 20B are a flowchart illustrating a method of controlling vibrations during the dehydrating process of a washing machine as shown in FIG. 19.
Figure 20B:
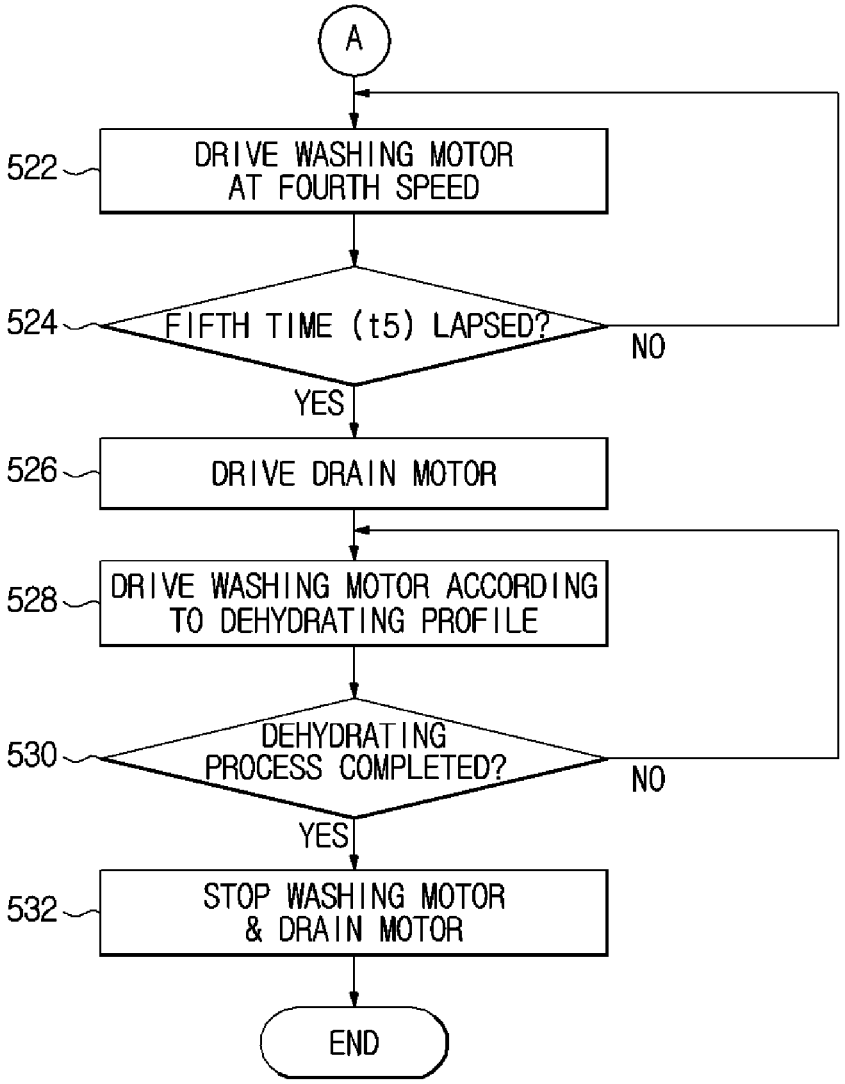

Before the description of FIGS. 19, 20A, and 20B, same reference numerals and notations are used to same elements as those of FIGS. 1, 11A, and 11B and duplicated descriptions will be omitted.

FIG. 19 is a sectional view illustrating a washing machine having a ball balancer according to still another embodiment.

As illustrated in FIG. 19, in a washing machine 1 according to still another embodiment, ball balancers 90 are installed at both of the upper side and the lower side of the rotating tub 12.

In a case when the ball balancers 90 are installed at both of the upper side and the lower side of the rotating tub 12, the resonant point (about 45 RPM to 50 RPM) is lowered than a case when the ball balancer 90 is installed at only one of the upper side and the lower side of the rotating tub 12, the rotating speed of the washing motor 14 is set to the third speed (about less 55 RPM) lower than the first speed.

In addition, since the resonant point at which the excessive vibrations of the tub 11 are generated in the early dehydrating process may be different according to the volume of the tub 11, the rotating speed and the driving time of the washing motor 14 may be varied by taking the volume of the tub 11 into consider.

Moreover, a case when the ball balancers 90 are installed at both of the upper side and the lower side of the rotating tub 12 may maintain balancing of the rotating tub 12 more stable than a case when the ball balance 90 is installed at only one of the upper side and the lower side of the rotating tub 12. Since, when all of the balls 92 of the ball balancers 90 installed at the upper side and the lower side of the rotating tub are positioned at the same phase (same position) as that of the unbalanced load generated by the unbalanced laundry W, the ball balancers 90 installed at both of the upper side and the lower side of the rotating tub 12 generate the excessive vibrations of the tub 11 more worse than the ball balancer 90 installed at only one of the upper side and the lower side of the rotating tub 12, the driving time of the washing motor 14 is set to the third time (about longer than 30 seconds) longer than the first time to perform the ball releasing process of releasing the balls 92 in the ball balancers 90. This will be described with reference to FIGS. 20A and 20B.

FIGS. 20A and 20B are a flowchart illustrating a method of controlling vibrations during the dehydrating process of a washing machine as shown in FIG. 19, and related to an algorithm of effectively reducing and vibrations of the tub 11 generated by concentration of the balls 92 and the unbalanced laundry W while entering the dehydrating process.

In FIGS. 20A and 20B, a user puts laundry into the rotating tub 12, manipulates buttons of the input unit 70 and selects operating information such as a washing course and a rinsing course according to type of the laundry. Thus, the operating information selected by the user is inputted to the control unit 72 through the input unit 70.

The control unit 72 performs a series of operations to perform the dehydrating process via the washing process and the rinsing process according to the operating information inputted from the input unit 70. For the control of vibrations in the dehydrating process, the control unit 72 determines whether a washing process or a rinsing process is completed (500).

As a result of the determination in operation 500, when the washing process or the rinsing process is completed, the control unit 72 performs drain operation of draining water within the tub 11 to the outside through the drain tubes 21 and 23 by driving the drain motor 22 through the driving unit 76 (502).

At this time, the control unit 72 detects level of the tub 11 lowering by the draining, that is, level of the water (residual water) remaining in the tub 11 through the level sensor 30 and determines whether the detected level is a first level (504).

As a result of the determination in operation 504, when the level of the residual water is not the first level, the control unit 72 continues the drain by driving the drain motor 22 until the level of the residual water reaches the first level.

Meanwhile, as a result of the determination in operation 504, when the level of the residual water reaches the first level, the control unit 72 stops the drain motor 22 through the driving unit 76 to stop the drain (506).

Thus, when the residual water at the first level (about 50 L) remains in the tub 11, the control unit 72 drives the washing motor 14 through the driving unit 76 at a first speed (a rotating speed of the washing motor lower than the resonant point; about 70 RPM) (508). The eccentricity generated as the washing motor 14 is driven at the first speed is detected by the vibration sensor 60 and is transmitted to the control unit 72 (510).

Thus, the control unit 72 compares the eccentricity data detected by the vibration sensor 60 with the reference data to determine whether the detected data is smaller than the reference data (512).

As a result of the determination in operation 512, when the detected data is smaller than the reference data, the control unit 72, before starting the dehydrating process, sets quantity of the residual water differently according to the eccentricity detected by the vibration sensor 60 (514).

When the quantity of residual water is set according to the eccentricity, the control unit 72 drives the drain motor 22 by the driving unit 76 (ON) such that the drain where water within the tub 11 is drained through the drain tubes 21 and 23 is performed (516).

The control unit 72 detects the level of the tub 11 lowering as the drain operation is performed, that is, the level of water remaining in the tub 11 (residual water) through the level sensor 30 and determines whether the detected level is a set level (518).

As a result of the determination in operation 518, when the level of the residual water is not the set level, the control unit 72 drives the drain motor 22 to continue the draining operation until the level of the residual water reaches the set level.

Meanwhile, as a result of the determination in operation 518, when the level of the residual water reaches the set level, the control unit 72 stops the drain motor 22 through the driving unit 76 to stop the draining operation (520).

Thus, in the state that the residual water as much as the set level (about 15 L) determined according to the eccentricity remains in the tub 11, the control unit 72 drives the washing motor 14 in a direction at a third speed (a rotating speed of the washing motor to release the balls in the ball balancer; about 45 RPM to 50 RPM) through the driving unit 76 (522).

When the washing motor 14 is driven at the fourth speed without draining the water in the tub 11 completely but retaining the residual water at the set level (for example, 15 L), the residual water remaining in the tub 11 acts as a balancer even when the ball balancer 90 does not maintain balance of the rotating tub 12 before the rotating rub 12 rotates faster than a preset speed and reduces vibrations of the tub while passing through the resonant point (a rotating speed of the washing motor at which vibrations of the tub are maximum; about less than 80 RPM) in the early entering the dehydrating process.

Next, the control unit 72 counts time of driving the washing motor 14 at the fourth speed in a direction and determines whether the counted time elapses a fifth preset time t5 (a driving time of the washing motor for releasing the balls within the ball balancer; about longer than 30 seconds) (524).

As a result of the determination in operation 524, when the counted time does not elapse the fifth preset time t5, the control unit 72 returns back to operation 522 to maintain the rotating speed of the washing motor 14 at the third speed until the counted time elapses the fourth preset time t4 not to concentrate but release the balls 92 within the ball balancer 90.

As such, the control unit 72 may reduce vibrations of the tub 11 using the weight of the residual water by starting the dehydrating process while retaining the residual water at the set level (about 15 L) during the dehydrating process and release the balls 92 within the ball balancer 90 by maintaining the rotating speed of the washing motor 14 at the fourth speed (about 45 RPM to 50 RPM) while passing through the resonant point (about less than 80 RPM) for the fifth preset time t5 (about longer than 30 seconds).

Meanwhile, as a result of the determination in operation 524, when the fifth preset time t5 has elapsed, the control unit 72 drives the drain motor 22 through the driving unit 76 again to start the draining operation of the residual water in the tub 11 (526).

The control unit 72 performs the dehydrating process to remove moisture contained in the laundry W while draining of the residual water. To this end, the control unit 72 drives the rotating tub 12 at a high speed by controlling the rotating speed RPM of the washing motor 14 according to a dehydrating profile through the driving unit 76 (528). In this case, since the drain motor 22 maintains the driven state ON, the moisture removed from the laundry W is drained with the residual water.

Next, the control unit 72 determines whether dehydrating process is completed (530), the control unit 72 returns back to operation 528 to accelerate the washing motor 14 at a preset rotating speed (a dehydrating speed) according to the dehydrating profile when the dehydrating process is not completed.

After passing through the resonant point, the residual water remained in the tub 11 is drained and the rotating speed of the washing motor 14 is accelerated according to the preset dehydrating profile to reduce the drain noise and decrease the dehydrating time.

Meanwhile, as a result of the determination in operation 530, when the dehydrating process is completed, the control unit 72 stops the washing motor 14 and the drain motor 22 through the driving unit 76 and finishes the dehydrating (532).

Moreover, as a result of the determination in operation 512, when the detected data is not smaller than the reference data, the control unit 72 determines that the eccentricity caused by the unbalanced laundry is large and the cloth untangling process may be performed, performs the cloth untangling process without entering the dehydrating process (540), and returns back to operation 508 to perform next operations.

As such, when the dehydrating process is performed using the ball balancer 90 and weight of the residual water remaining in the tub 11, the excessive vibrations of the tub 11 may be significantly reduced in comparison to a case when the dehydrating process is performed using an existing ball balancer or a liquid balancer. This is depicted in FIG. 21.

Figure 21:
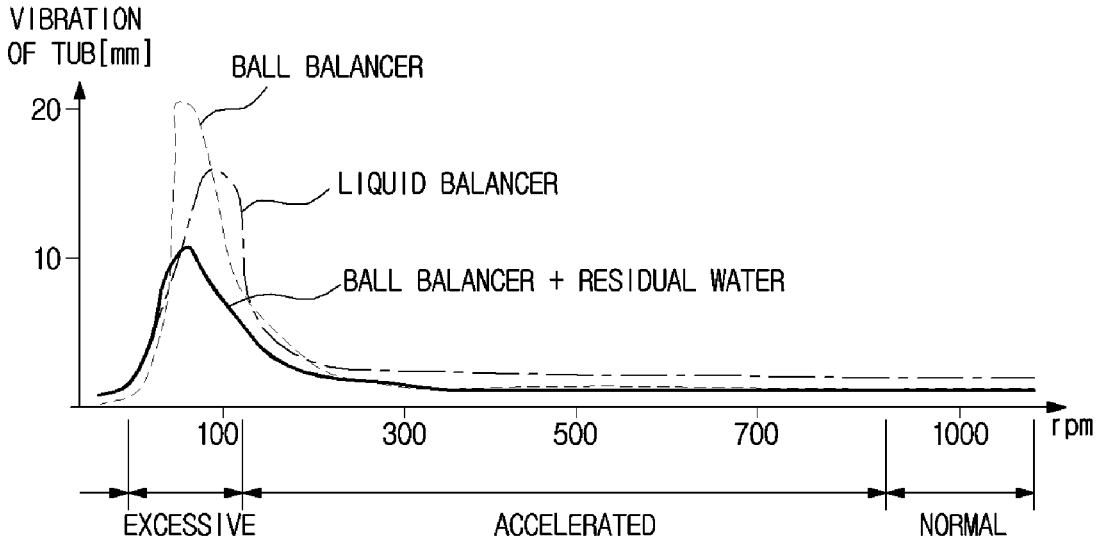
FIG. 21 is a graph illustrating amplitudes of vibrations of a tub of a washing machine having a ball balancer according to an embodiment.

FIG. 21 is a graph illustrating amplitudes of vibrations of a tub of a washing machine having a ball balancer according to an embodiment.

As illustrated in FIG. 21, when the dehydrating process is performed using the ball balancer 90 and weight of the residual water according to embodiments of the present embodiment, the vibration displacement of the tub 11 is remarkably low while passing through the resonant point (an excessive vibration region) in the early entering the dehydrating process in comparison to that of a case when the dehydrating process is performed using only a ball balancer 80 or a liquid balancer 95.

Meanwhile, in an embodiment, described is the dehydrating process of reducing vibrations of the tub 11, generated by the concentrated balls 92 and the unbalanced laundry W using the weight of the residual water in the washing machine 1 having the ball balancer 90, but is not limited thereto. The present embodiment may be achieved in a case when both of the ball balancer 90 and the liquid balancer 95 are employed. This case will be described with reference to FIGS. 22 and 23.

Figure 22:
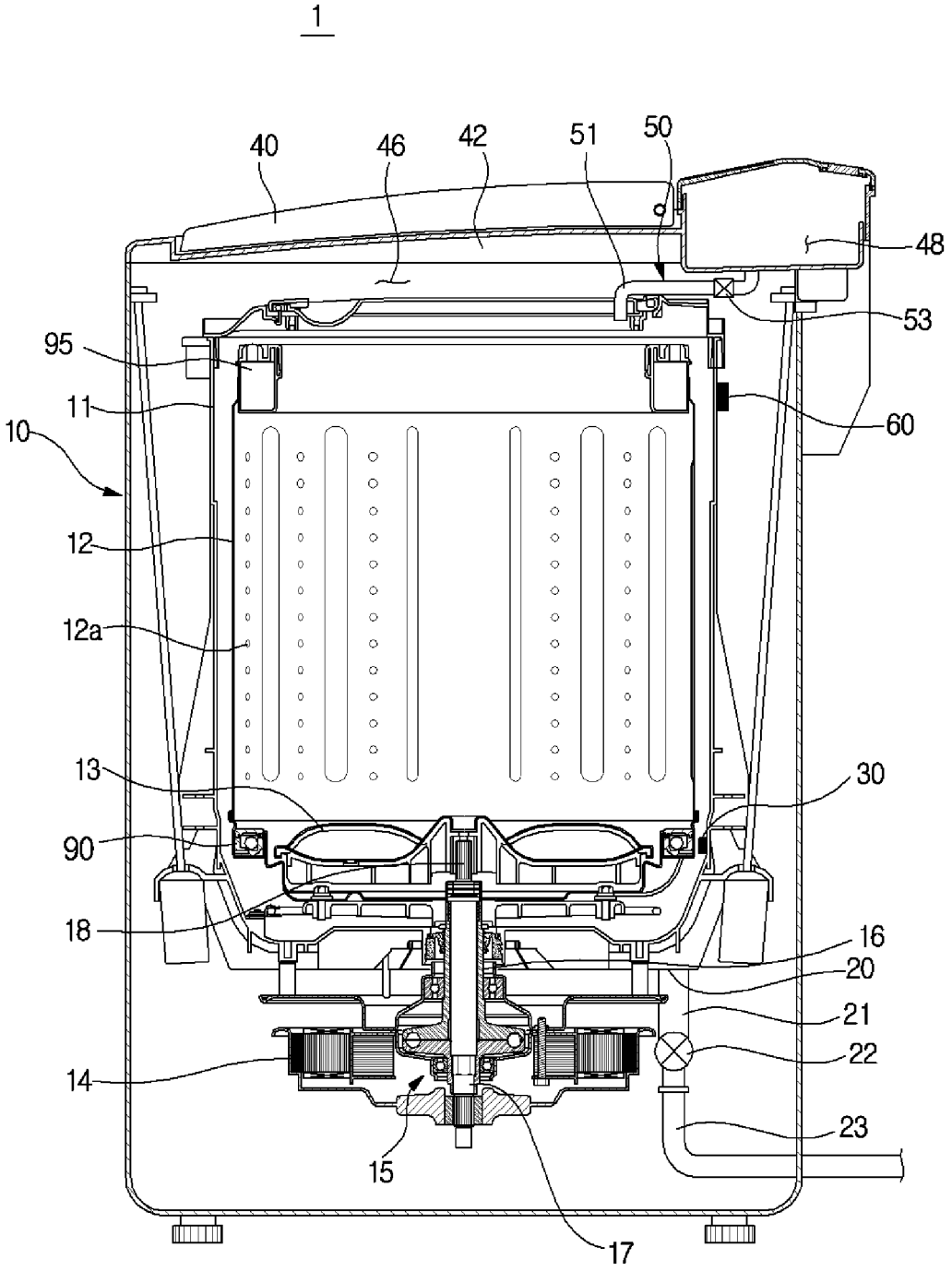
FIG. 22 is a sectional view illustrating a washing machine having a ball balancer and a liquid balancer according to still another embodiment.
Figure 23:
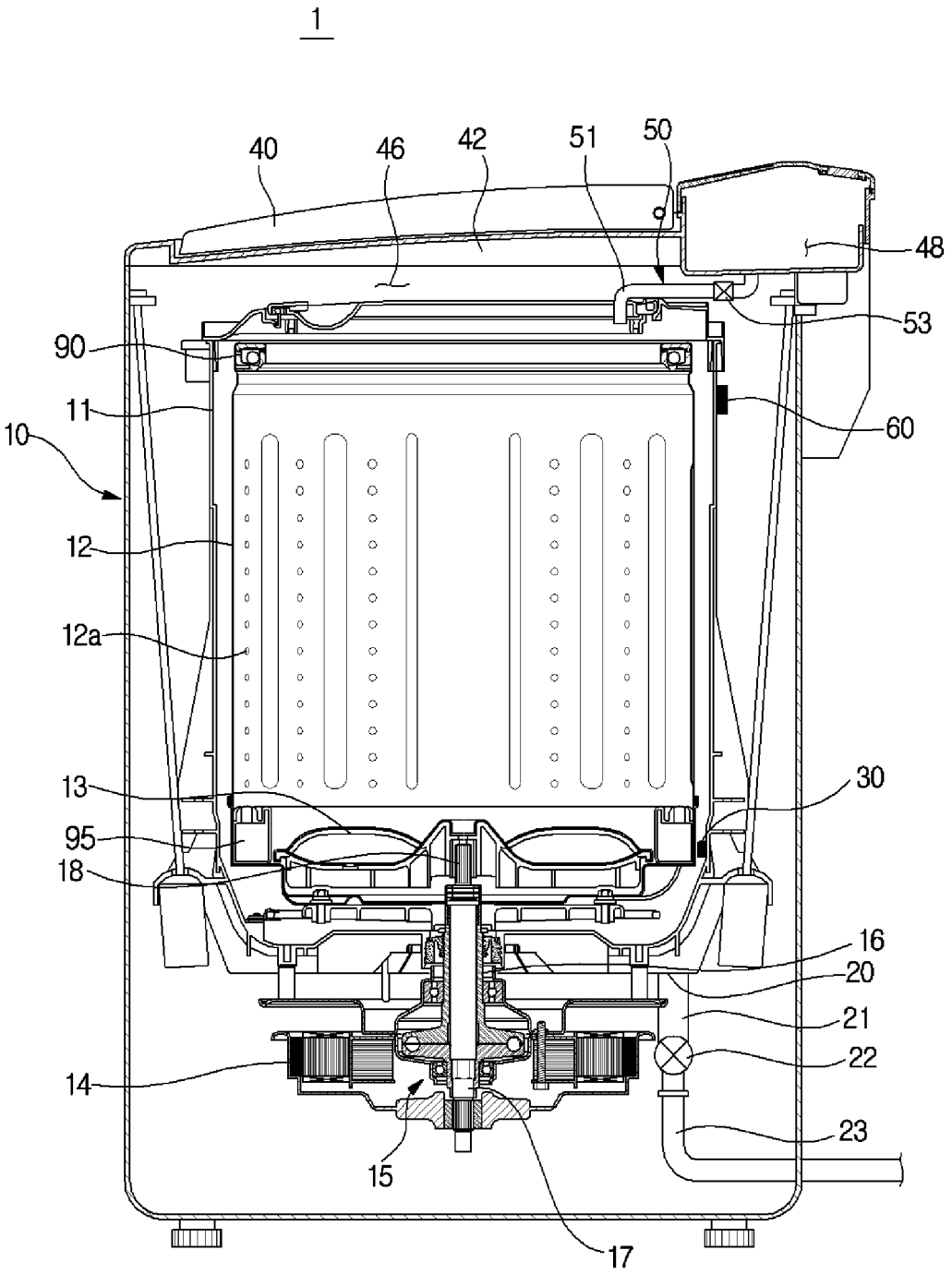
FIG. 23 is a sectional view illustrating a washing machine having a ball balancer and a liquid balancer according to still another embodiment.

FIG. 22 is a sectional view illustrating a washing machine having a ball balancer and a liquid balancer according to still another embodiment, and FIG. 23 is a sectional view illustrating a washing machine having a ball balancer and a liquid balancer according to still another embodiment.

FIG. 22 illustrates a washing machine 1 according to still another embodiment in which a ball balancer 90 is installed at the lower side of the rotating tub 12 and the liquid balancer 95 is installed at the upper side of the rotating tub 12.

FIG. 23 illustrates a washing machine 1 according to still another embodiment in which a ball balancer 90 is installed at the upper side of the rotating tub 12, while a liquid balancer 95 is installed at the lower side of the rotating tub 12.

As illustrated in FIGS. 22 and 23, it is designed the ball balancer 90 accommodating balls 92 is designed about 34 mm high while the liquid balancer accommodating a liquid is designed about 87.5 mm high. Thus, the height of the ball balancer 90 is remarkably lower than that of the liquid balancer 95.

Since the washing machines 1 as shown in FIGS. 22 and 23 maintain the balancing of the rotating tub 12 within a shorter time than a case when only a ball balancer 90 is installed at the upper or lower side of the rotating tub 12, the rotating speed of the washing motor 14 is set faster or slower than the first speed and the driving time of the washing motor 14 is shorter or longer than the first time to perform the ball releasing process of releasing the balls 92 in the ball balancer 90 so that vibrations of the tub 11 may be effectively reduced.

Although a fully automatic washing machine having a vertical shaft has been described in the above embodiments of the present embodiment, the present embodiment is not limited thereto the same aspects and effects of the present embodiment may be achieved in a drum washing machine having a horizontal shaft.

Although a few embodiments of the present embodiment have been shown and described, it would be appreciated by those skilled in the art that changes may be made in these embodiments without departing from the principles and spirit of the invention, the scope of which is defined in the claims and their equivalents.

What is claimed is:

1. A method comprising:

controlling, by a controller of a washing machine, a drain motor of the washing machine to drain water in a tub of the washing machine to a first water level and maintain the water in the tub at the first water level, controlling, by the controller, the washing motor to rotate a drum in the tub of the washing machine at a first speed while the water in the tub is maintained at the first water level, determining, by the controller, a degree of eccentricity of the tub based on a detected vibration of the tub while the drum is rotated at the first speed, determining, by the controller, a residual water level according to the determined degree of eccentricity of the tub, controlling, by the controller, the drain motor to drain the water in the tub from the first water level to the determined residual water level and maintain the water in the tub at the residual water level, controlling, by the controller, the washing motor to rotate the drum at a second speed, higher than the first speed, for a predetermined time while the water in the tub is maintained at the residual water level, after the predetermined time has passed, controlling, by the controller, the washing motor to rotate the drum at a third speed higher than the second speed, and when a speed of a rotation of the drum is greater than or equal to the third speed, controlling, by the controller, the drain motor to drain the water in the tub to empty the tub.

2. A washing machine comprising:

a tub to accommodate water;

a drum rotatably installed in the tub;

a washing motor configured to rotate the drum;

a vibration sensor configured to detect a vibration of the tub;

a drain motor configured to drain the water in the tub; and a control unit configured to:

control the drain motor to drain the water in the tub to a first water level and maintain the water in the tub at the first water level, control the washing motor to rotate the drum at a first speed while the water in the tub is maintained at the first water level, determine a degree of eccentricity of the tub based on the detected vibration of the tub while the drum is rotated at the first speed, determine a residual water level according to the determined degree of eccentricity of the tub, control the drain motor to drain the water in the tub from the first water level to the determined residual water level and maintain the water in the tub at the residual water level, control the washing motor to rotate the drum at a second speed, higher than the first speed, for a predetermined time while the water in the tub is maintained at the residual water level, after the predetermined time has passed, control the washing motor to rotate the drum at a third speed higher than the second speed, and when a speed of a rotation of the drum is greater than or equal to the third speed, control the drain motor to drain the water in the tub to empty the tub.

3. The washing machine according to claim 2, wherein the first speed is lower than a predetermined resonant speed.

4. The washing machine according to claim 3, wherein the predetermined resonant speed corresponds to a maximum vibration of the tub.

5. The washing machine according to claim 3, wherein the second speed is lower than the predetermined resonant speed.

6. The washing machine according to claim 3, wherein the third speed is higher than the predetermined resonant speed.

7. The washing machine according to claim 2, further comprising:

a ball balancer accommodating a liquid to stabilize the rotation of the drum, wherein balls contained in the ball balancer are released while the drum is rotated at the second speed for the predetermined time.

8. The washing machine according to claim 7, wherein the washing motor is configured to rotate the drum in one direction at the second speed.

9. The washing machine according to claim 8, wherein the washinq motor is controlled to rotate at the first speed while the water in the tub is drained from the first water level to the determined residual water level.

10. The washing machine according to claim 7, further comprising:

a liquid balancer to stabilize the rotation of the drum, wherein the ball balancer and the liquid balancer are installed at an upper side and a lower side of the drum, respectively.

* * * * *